US010416586B2

(12) United States Patent
Takino et al.

(10) Patent No.: US 10,416,586 B2
(45) Date of Patent: Sep. 17, 2019

(54) IMAGE FORMING APPARATUS THAT FORMS AN IMAGE WITH A TEXTILE PRINTING TONER INCLUDING A TEXTILE PRINTING DYE

(71) Applicant: Oki Data Corporation, Tokyo (JP)

(72) Inventors: Yuji Takino, Tokyo (JP); Naoki Masui, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/038,395

(22) Filed: Jul. 18, 2018

(65) Prior Publication Data

US 2019/0033745 A1 Jan. 31, 2019

(30) Foreign Application Priority Data

Jul. 26, 2017 (JP) ..... 2017-144377
Apr. 25, 2018 (JP) ..... 2018-083834

(51) Int. Cl.
*G03G 15/01* (2006.01)
*G03G 15/16* (2006.01)
*G03G 15/00* (2006.01)

(52) U.S. Cl.
CPC ..... *G03G 15/0131* (2013.01); *G03G 15/1605* (2013.01); *G03G 15/1625* (2013.01); *G03G 15/6585* (2013.01); *G03G 15/6591* (2013.01); *G03G 2215/00527* (2013.01); *G03G 2215/16* (2013.01)

(58) Field of Classification Search
CPC ..... G03G 15/0131; G03G 15/1605; G03G 15/6585; G03G 2215/00527; G03G 2215/00801; G03G 2215/0122; G03G 2215/16; G03G 15/1625; G03G 15/6591
See application file for complete search history.

(56) References Cited

U.S. PATENT DOCUMENTS

2003/0007814 A1 1/2003 Richards
2009/0087221 A1* 4/2009 Masui ..... G03G 15/6585 399/223
2012/0045227 A1* 2/2012 Nakajima ..... G03G 15/0131 399/39
2012/0155940 A1* 6/2012 Hagiwara ..... G03G 15/6585 399/341
2012/0237698 A1* 9/2012 Funahashi ..... G03G 7/0053 428/32.6

(Continued)

FOREIGN PATENT DOCUMENTS

JP 2015-176032 A 10/2015

*Primary Examiner* — Sophia S Chen
(74) *Attorney, Agent, or Firm* — Rabin & Berdo, P.C.

(57) ABSTRACT

An image forming apparatus includes an image forming section. The image forming section includes: a first toner image forming unit that forms a textile printing toner image with a textile printing toner; and a second toner image forming unit that forms a first dyeing-target toner image with a dyeing-target toner. The image forming section disposes the textile printing toner image and the first dyeing-target toner image in this order on a print medium. The textile printing toner includes a textile printing dye. The dyeing-target toner includes a polymer compound that is to be dyed with the textile printing dye.

9 Claims, 14 Drawing Sheets

(56) References Cited

U.S. PATENT DOCUMENTS

| | | | | |
|---|---|---|---|---|
| 2013/0004742 | A1* | 1/2013 | La Costa | G03G 15/1625<br>428/195.1 |
| 2015/0261165 | A1* | 9/2015 | Hoshino | G03G 15/6585<br>399/400 |
| 2015/0338759 | A1* | 11/2015 | Ida | G03G 15/6585<br>399/40 |

* cited by examiner

IMAGE FORMING APPARATUS THAT FORMS AN IMAGE WITH A TEXTILE PRINTING TONER INCLUDING A TEXTILE PRINTING DYE

CROSS REFERENCE TO RELATED APPLICATIONS

The present application claims priority from Japanese Patent Application No. 2017-144377 filed on Jul. 26, 2017 and Japanese Patent Application No. 2018-083834 filed on Apr. 25, 2018, the entire contents of each which are hereby incorporated by reference.

BACKGROUND

The technology relates to an image forming apparatus that forms an image with a textile printing toner including a textile printing dye.

An image forming apparatus using an electrophotographic scheme is in widespread use. One reason for this is that the image forming apparatus using the electrophotographic scheme is able to achieve a high-quality image in a shorter time, compared with an image forming apparatus using other scheme such as an inkjet scheme.

The image forming apparatus using the electrophotographic scheme forms an image on a print medium with a toner. In a process of forming an image, the toner attached to a latent image is transferred onto the print medium, and the toner is thereafter fixed to the print medium.

Various applications have been proposed of an image formed by an image forming apparatus. For example, after an image is formed on a print medium, the image is transferred from the print medium onto a non-print medium, such as fabric, other than the print medium. The image is thereby formed on the non-print medium. For example, reference may be made to Japanese Unexamined Patent Application Publication No. 2015-176032.

SUMMARY

It has been proposed to form an image on a non-print medium, such as fabric, other than a print medium by utilizing an image formed on the print medium. However, quality of the image to be formed on the non-print medium has not been high enough, which still leaves a room for improvement in the quality of the image to be formed on the non-print medium.

It is desirable to provide an image forming apparatus that makes it possible to form a high-quality image on a non-print medium, such as fabric, other than a print medium, when an image formed on the print medium is transferred onto the non-print medium other than the print medium.

According to one embodiment of the technology, there is provided an image forming apparatus including an image forming section that includes: a first toner image forming unit that forms a textile printing toner image with a textile printing toner; and a second toner image forming unit that forms a first dyeing-target toner image with a dyeing-target toner. The image forming section disposes the textile printing toner image and the first dyeing-target toner image in this order on a print medium. The textile printing toner includes a textile printing dye. The dyeing-target toner includes a polymer compound that is to be dyed with the textile printing dye.

DETAILED DESCRIPTION

Figure 1:
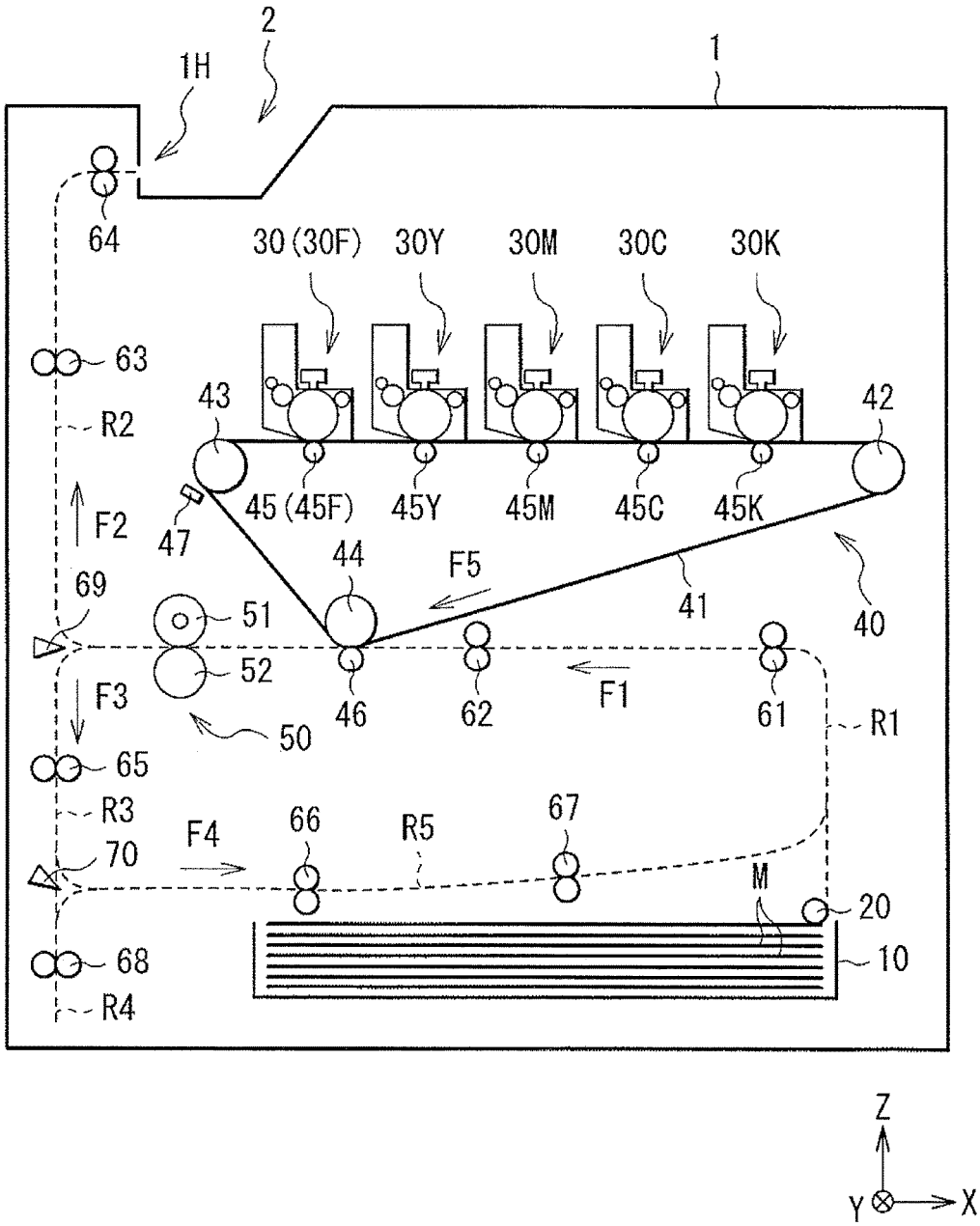
FIG. 1 is a plan view of an example of a configuration of an image forming apparatus according to one example embodiment of the technology.

Some example embodiments of the technology are described in detail below in the following order with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Image Forming Apparatus (First Example Embodiment)
1-1. General Configuration
1-2. Configuration of Developing Unit
1-3. Block Configuration
1-4. Configuration of Toner
1-5. Operation
1-6. Example Workings and Example Effects
2. Image Forming Apparatus (Second Example Embodiment)
2-1. Configuration
2-2. Operation
2-3. Example Workings and Example Effects
3. Application Examples of Image
3-1. Method of Transferring Image Formed by Image Forming Apparatus According to First Example Embodiment
3-2. Method of Transferring Image Formed by Image Forming Apparatus According to Second Example Embodiment
4. Modification Examples

1. IMAGE FORMING APPARATUS (FIRST EXAMPLE EMBODIMENT)

A description is given first of an image forming apparatus according to a first example embodiment of the technology.

The image forming apparatus according to the first example embodiment may form, by the use of a toner, an image on a print medium M which will be described later with reference to FIG. 1, for example. The image forming apparatus according to the first example embodiment may be a so-called full-color printer using an electrophotographic scheme.

For example, the image forming apparatus according to the first example embodiment may employ, as an image formation method, an intermediate transfer method that forms an image on the print medium M by the use of an intermediate transfer belt 41 which will be described later.

The print medium M is not particularly limited in its type; however, the print medium M may include one or more of materials such as paper or a film, for example.

[1-1. General Configuration]

A description is given first of a general configuration of the image forming apparatus.

FIG. 1 illustrates an example of a planar configuration of the image forming apparatus. The image forming apparatus may involve conveyance of the print medium M along respective conveyance routes R1 to R5 in the process of forming an image. Each of the conveyance routes R1 to R5 is illustrated by a dashed line in FIG. 1.

Referring to FIG. 1, the image forming apparatus may include, inside a housing 1, a tray 10, a feeding roller 20, a developing unit 30, a transfer section 40, a fixing section 50, conveying rollers 61 to 68, and conveyance path switching guides 69 and 70, for example.

The image forming apparatus may be able to form an image only on one side of the print medium M and also able to form images on both sides of the print medium M, for example.

Hereinafter, when the image forming apparatus forms the image only on one side of the print medium M, the surface on which the image is to be formed is referred to as a "front surface" of the print medium M. Further, a surface, of the print medium M, opposite to foregoing one side, i.e., the front surface, is referred to as a "back surface" of the print medium M. When the image forming apparatus forms images on both sides of the print medium M, an image is formed on each of the front surface and the back surface of the print medium M.

[Housing]

The housing 1 may include one or more of materials such as a metal material and a polymer material, for example. The housing 1 may be provided with a stacker 2 to which the print medium M provided with a formed image is to be discharged. The print medium M provided with the formed image may be discharged from a discharge opening 1H provided in the housing 1 to the stacker 2.

[Tray and Feeding Roller]

The tray 10 may be detachably attached to the housing 1, for example. The tray 10 may contain the print medium M, for example. The feeding roller 20 may be a cylindrical member that extends in a Y-axis direction and is rotatable around an Y-axis, for example. Each of the members referred to by the name including the term "roller" out of a series of members described below may be a cylindrical member that extends in the Y-axis direction and is rotatable around the Y-axis, as with the feeding roller 20.

The tray 10 may contain a stack of print media M, for example. The print media M contained in the tray 10 may be picked out one by one from the tray 10 by the feeding roller 20, for example.

The tray 10 may be provided in any number, which may be only one or two or more. The feeding roller 20 may be provided in any number, which may be only one or two or more. FIG. 1 illustrates an example case in which one tray 10 and one feeding roller 20 are provided.

[Developing Unit]

The developing unit 30 may perform, by the use of a toner, a process of attaching the toner to a latent image, i.e., an electrostatic latent image. In other words, the developing unit 30 may perform a developing process. For example, the developing unit 30 may mainly form the electrostatic latent image, and attach the toner to the electrostatic latent image by utilizing Coulomb force.

In this example, the image forming apparatus may include five developing units 30, i.e., developing units 30F, 30Y, 30M, 30C, and 30K. The developing unit 30F may correspond to a "second toner image forming unit" in one specific but non-limiting embodiment of the technology. Each of the developing units 30Y, 30M, 30C, and 30K may correspond to a "first toner image forming unit" in one specific but non-limiting embodiment of the technology.

The developing units 30F, 30Y, 30M, 30C, and 30K each may be detachably attached to the housing 1, and may be disposed along a traveling path of an intermediate transfer belt 41 which will be described later, for example. In this example, the developing units 30F, 30Y, 30M, 30C, and 30K may be disposed in this order from upstream toward downstream in a traveling direction, illustrated by an arrow F5, in which the intermediate transfer belt 41 travels.

The developing units 30F, 30Y, 30M, 30C, and 30K may have configurations similar to each other, except for having toners different in type from each other, for example. The toners may each be contained in a cartridge 38 which will be described later referring to FIG. 2, for example. In one example, two types of toners may be used: a dyeing-target toner, i.e., a toner to be dyed, and a textile printing toner.

In one example, the developing unit 30F may contain the dyeing-target toner. The developing unit 30Y may contain, for example, a yellow textile printing toner that is the textile printing toner. The developing unit 30M may contain, for example, a magenta textile printing toner that is the textile printing toner. The developing unit 30C may contain, for example, a cyan textile printing toner that is the textile printing toner. The developing unit 30K may contain, for example, a black textile printing toner that is the textile printing toner.

Each of the yellow textile printing toner, the magenta textile printing toner, the cyan textile printing toner, and the black textile printing toner may be used in forming a full-color image. In one example, each of the yellow textile printing toner, the magenta textile printing toner, the cyan textile printing toner, and the black textile printing toner may be a colored toner that is to be moved onto a non-print medium L by utilizing sublimation transfer properties upon being heated. The non-print medium L will be described later in greater details referring to FIG. 11. As used herein, the term "non-print medium" refers to a medium different from the print medium M on which an image is formed by the image forming apparatus, and may refer to a medium such as fabric which will be described later. The term "dyeing-target toner" refers to, for example, a toner that is to be dyed with a colorant included in each of the yellow textile printing toner, the magenta textile printing toner, the cyan textile printing toner, and the black textile printing toner described above, when the image formed on the print medium M is transferred onto the non-print medium L. The colorant included in each of the yellow textile printing toner, the magenta textile printing toner, the cyan textile printing toner, and the black textile printing toner described above may be, for example, a textile printing dye which will be described later.

Hereinafter, an individual term such as the "dyeing-target toner", the "yellow textile printing toner", the "magenta textile printing toner", the "cyan textile printing toner", or the "black textile printing toner" may be used in some cases; however, a collective term may be also used in other cases on an as-needed basis. For example, the dyeing-target toner, the yellow textile printing toner, the magenta textile printing toner, the cyan textile printing toner, and the black textile printing toner may be collectively referred to as a "toner". The yellow textile printing toner, the magenta textile printing toner, the cyan textile printing toner, and the black textile printing toner may be collectively referred to as a "textile printing toner".

Each of the developing units 30Y, 30M, 30C, and 30K may form a textile printing toner image Z2 by the textile printing toner, i.e., corresponding one of the yellow textile printing toner, the magenta textile printing toner, the cyan textile printing toner, and the black textile printing toner. In contrast, the developing unit 30F may form a dyeing-target toner image Z1 by the dyeing-target toner. The textile printing toner image Z2 and the dyeing-target toner image Z1 will be described later with reference to FIGS. 4 and 5.

A configuration of each of the developing units 30F, 30Y, 30M, 30C, and 30K will be described later with reference to FIG. 2. A configuration of each of the dyeing-target toner, the yellow textile printing toner, the magenta textile printing toner, the cyan textile printing toner, and the black textile printing toner will be also described later.

[Transfer Section]

The transfer section 40 may perform a transfer process by the use of the toner that has been subjected to the developing process by the developing unit 30. For example, the transfer section 40 may mainly transfer, onto the print medium M, the toner attached to the electrostatic latent image by the developing unit 30.

The transfer section 40 may include the intermediate transfer belt 41, a driving roller 42, a driven roller 43, a backup roller 44, a primary transfer roller 45, a secondary transfer roller 46, and a cleaning blade 47, for example.

Figure 4:
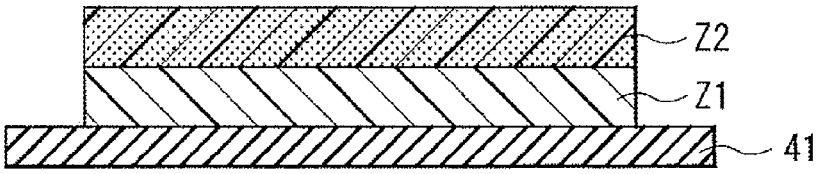
FIG. 4 is a cross-sectional view of an example of a configuration of an intermediate transfer belt on which a dyeing-target toner image and a textile printing toner image are formed.
Figure 5:
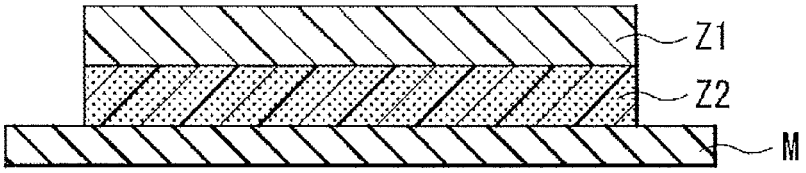
FIG. 5 is a cross-sectional view of an example of a configuration of a print medium on which the dyeing-target toner image and the textile printing toner image are formed.

For example, as will be described later, the transfer section 40 may transfer the dyeing-target toner image Z1 and the textile printing toner image Z2 in this order onto the intermediate transfer belt 41, as illustrated in FIG. 4. Thereafter, the transfer section 40 may transfer the textile printing toner image Z2 and the dyeing-target toner image Z1 in this order from the intermediate transfer belt 41 onto the print medium M, as illustrated in FIG. 5. The transfer section 40 may thereby dispose the textile printing toner image Z2 and the dyeing-target toner image Z1 in this order on the print medium M. The intermediate transfer belt 41 may correspond to an "intermediate transfer medium" in one specific but non-limiting embodiment of the technology.

The intermediate transfer belt 41 may be a medium onto which the toner is temporarily transferred before the toner is transferred onto the print medium M. The intermediate transfer belt 41 may be an elastic endless belt, for example. The intermediate transfer belt 41 may include one or more of polymer materials such as polyimide, for example. The intermediate transfer belt 41 may be able to travel, for example, in response to rotation of the driving roller 42, while lying on the driving roller 42, the driven roller 43, and the backup roller 44 in a stretched state.

The driving roller 42 may be rotatable, for example, by means of a belt motor 91 which will be described later with reference to FIG. 3. Each of the driven roller 43 and the backup roller 44 may be rotatable in accordance with the rotation of the driving roller 42, for example.

The primary transfer roller 45 may transfer, onto the intermediate transfer belt 41, the toner attached to the electrostatic latent image. In other words, the primary transfer roller 45 may perform primary transfer. The primary transfer roller 45 may be so pressed against the developing unit 30 as to be in contact with the developing unit 30 with the intermediate transfer belt 41 in between. For example, the primary transfer roller 45 may be so pressed against a photosensitive drum 32 as to be in contact with the photosensitive drum 32 with the intermediate transfer belt 41 in between. The photosensitive drum 32 will be described later with reference to FIG. 2. The primary transfer roller 45 may be rotatable, for example, by means of a roller motor 88 which will be described later with reference to FIG. 3.

The primary transfer roller 45 may be provided in any number, which may be only one or two or more. In this example, the transfer section 40 may include five primary transfer rollers 45, i.e., primary transfer rollers 45F, 45Y, 45M, 45C, and 45K corresponding to the five developing units 30, i.e., the developing units 30F, 30Y, 30M, 30C, and 30K described above. The transfer section 40 may also include a single secondary transfer roller 46 corresponding to the single backup roller 44.

The secondary transfer roller 46 may transfer, onto the print medium M, the toner that has been transferred onto the intermediate transfer belt 41. In other words, the secondary transfer roller 46 may perform secondary transfer. The secondary transfer roller 46 may be so pressed against the backup roller 44 as to be in contact with the backup roller 44. The secondary transfer roller 46 may include a core member and an elastic layer, for example. The core member may include metal, for example. The elastic layer may include a foamed rubber layer that covers an outer peripheral surface of the core member, for example. The secondary transfer roller 46 may be rotatable, for example, by means of the roller motor 88 which will be described later with reference to FIG. 3.

The cleaning blade 47 may be so pressed against the intermediate transfer belt 41 as to be in contact with the intermediate transfer belt 41. The cleaning blade 47 may scrape off unnecessary remains of the toner on the surface of the intermediate transfer belt 41.

[Fixing Section]

The fixing section 50 may perform a fixing process by the use of the toner that has been transferred onto the print medium M by the transfer section 40. For example, the fixing section 50 may mainly apply a pressure onto the print medium M onto which the toner has been transferred by the transfer section 40, while heating the print medium M. The fixing section 50 may thereby fix the toner to the print medium M. In other words, the fixing section 50 may fix the textile printing toner image Z2 and the dyeing-target toner image Z1 to the print medium M, after the textile printing toner image Z2 and the dyeing-target toner image Z1 are disposed in this order on the print medium M.

The fixing section 50 may include a heating roller 51 and a pressure-applying roller 52, for example.

The heating roller 51 may heat the toner transferred onto the print medium M. The heating roller 51 may include a metal core and resin coating that covers a surface of the metal core, for example. The resin coating may include one or more polymer materials such as a copolymer (PFA) of tetrafluoroethylene and perfluoroalkylvinylether or polytetrafluoroethylene (PTFE), for example.

Figure 3:
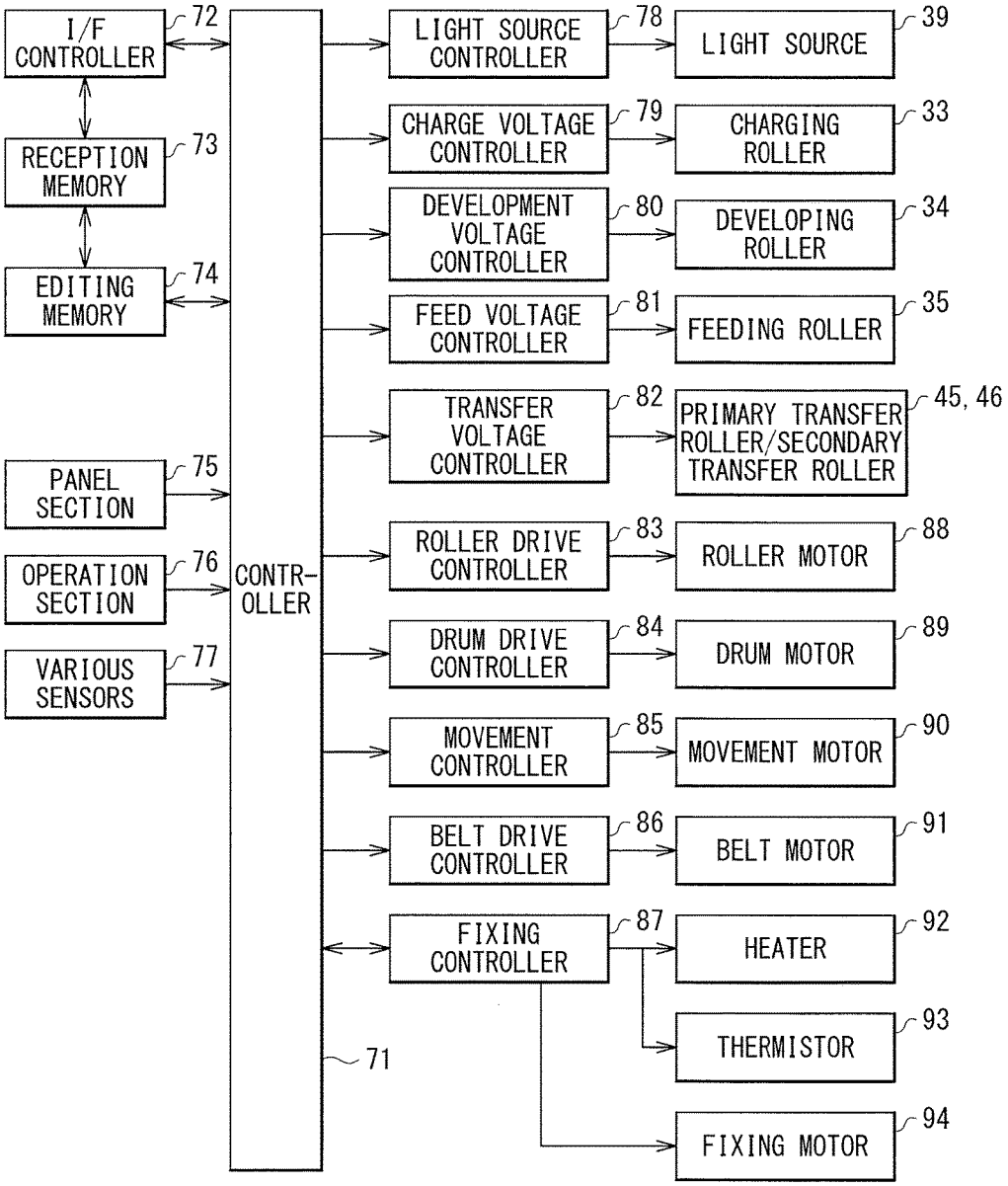
FIG. 3 is a block diagram illustrating an example of the configuration of the image forming apparatus according to one example embodiment.

The heating roller 51 may be provided with a heater 92 illustrated in FIG. 3 that is disposed inside the metal core of the heating roller 51, for example. Non-limiting examples of the heater 92 may include a halogen lamp. A thermistor 93 illustrated in FIG. 3 may be provided in the vicinity of the heating roller 51, for example. For example, the thermistor 93 may be so disposed as to be separated away from the heating roller 51. The thermistor 93 may measure surface temperature of the heating roller 51, for example.

The pressure-applying roller 52 may be so pressed against the heating roller 51 as to be in contact with the heating roller 51. The pressure-applying roller 52 may apply a pressure to the toner transferred onto the print medium M. The pressure-applying roller 52 may include a metal core and a heat-resistant elastic layer that covers a surface of the metal core, for example. The heat-resistant elastic layer may include one or more rubber materials such as silicone rubber, for example.

[Conveying Roller]

Each of the conveying rollers 61 to 68 may include a pair of rollers that face each other with corresponding one of the conveyance routes R1 to R5 in between. Each of the conveying rollers 61 to 68 may convey the print medium M that has been taken out by the feeding roller 20.

When the image is to be formed only on one side of the print medium M, i.e., only on the front surface of the print medium M, the print medium M may be conveyed by the conveying rollers 61 to 64 along the conveyance routes R1 and R2, for example. When the images are to be formed on both sides of the print medium M, i.e., on both the front surface and the back surface of the print medium M, the print medium M may be conveyed by the conveying rollers 61 to 68 along the conveyance routes R1 to R5, for example.

[Conveyance Path Switching Guide]

The conveyance path switching guides 69 and 70 each may switch a conveyance direction, of the print medium M, in which the print medium M is to be conveyed, depending on conditions such as a manner in which the image is formed on the print medium M. The manner in which the image is formed on the print medium M may include one-sided image printing of the print medium M and two-sided image printing of the print medium M, for example.

[1-2. Configuration of Developing Unit]

The configuration of the developing unit 30 is described below. FIG. 2 illustrates, in an enlarged fashion, a planar configuration of the developing unit 30, i.e., each of the developing units 30F, 30Y, 30M, 30C, and 30K, illustrated in FIG. 1.

As described above, the developing units 30F, 30Y, 30M, 30C, and 30K may have configurations similar to each other, except for having toners different in type from each other, for example. The toners may each be contained in the cartridge 38, for example.

Figure 2:
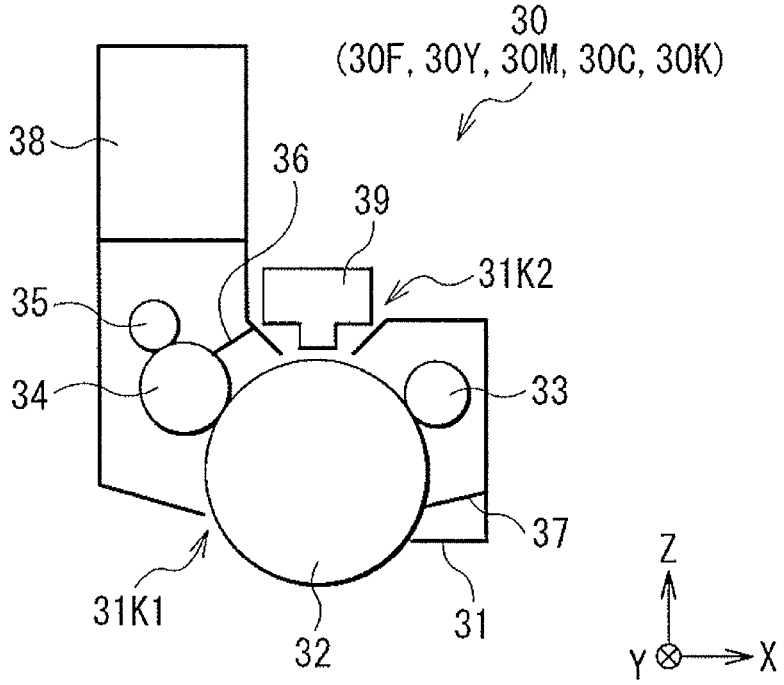
FIG. 2 is a plan view illustrating, in an enlarged fashion, an example of a configuration of a developing unit illustrated in FIG. 1.

Referring to FIG. 2, the developing units 30F, 30Y, 30M, 30C, and 30K each may include the photosensitive drum 32, a charging roller 33, a developing roller 34, a feeding roller 35, a developing blade 36, a cleaning blade 37, and the cartridge 38, for example. For example, a light source 39 may be attached to each of the developing units 30F, 30Y, 30M, 30C, and 30K.

The photosensitive drum 32, the charging roller 33, the developing roller 34, the feeding roller 35, the developing blade 36, and the cleaning blade 37 may be contained inside the housing 31, for example. The cartridge 38 may be detachably attached to the housing 31, for example. The light source 39 may be disposed outside of the housing 31, for example.

The developing units 30F, 30Y, 30M, 30C, and 30K may each be movable between a standby position and a contact position by means of a movement motor 90 which will be described later with reference to FIG. 3, for example. When the photosensitive drum 32 is located at the standby position, the photosensitive drum 32 may be retracted away from the intermediate transfer belt 41. Therefore, the photosensitive drum 32 may not be so pressed against the primary transfer roller 45 as to be in contact with the primary transfer roller 45 with the intermediate transfer belt 41 in between. In contrast, when the photosensitive drum 32 is located at the contact position, the photosensitive drum 32 may be advanced toward the intermediate transfer belt 41. Therefore, the photosensitive drum 32 may be pressed against the primary transfer roller 45 while being applied with a pressure with the intermediate transfer belt 41 in between.

[Housing]

The housing 31 may include one or more of materials such as a metal material and a polymer material, for example. The housing 31 may have, for example, an opening 31K1 from which the photosensitive drum 32 is partially exposed, and an opening 31K2 that guides light outputted from the light source 39 to the photosensitive drum 32.

[Photosensitive Drum]

The photosensitive drum 32 may mainly serve as a latent image holding member on which the electrostatic latent image is formed and that holds the electrostatic latent image. The photosensitive drum 32 may extend in the Y-axis direction, and be rotatable around the Y-axis. The photosensitive drum 32 may be an organic photoreceptor that includes a cylindrical electrically-conductive supporting body and a photoconductive layer, for example. The photoconductive layer may cover an outer peripheral surface of the electrically-conductive supporting body. The photosensitive drum 32 may be rotatable by means of a drum motor 89 which will be described later with reference to FIG. 3. The electrically-conductive supporting body may be a metal pipe that includes one or more of metal materials such as aluminum, for example. The photoconductive layer may be a stack that includes an electric charge generating layer and an electric charge transfer layer, for example. Part of the photosensitive drum 32 may be exposed from the opening 31K1 provided in the housing 31.

[Charging Roller]

The charging roller 33 may mainly electrically charge a surface of the photosensitive drum 32. The charging roller 33 may include a metal shaft and an electrically-semiconductive epichlorohydrin rubber layer that covers an outer peripheral surface of the metal shaft, for example. The charging roller 33 may be so pressed against the photosensitive drum 32 as to be in contact with the photosensitive drum 32.

[Developing Roller]

The developing roller 34 may mainly support the toner that is fed from the feeding roller 35, and mainly attach the fed toner onto the electrostatic latent image formed on the surface of the photosensitive drum 32. The developing roller 34 may include a metal shaft and an electrically-semiconductive urethane rubber layer that covers an outer peripheral surface of the metal shaft, for example. The developing roller 34 may be so pressed against the photosensitive drum 32 as to be in contact with the photosensitive drum 32.

[Feeding Roller]

The feeding roller 35 may mainly feed the toner to the surface of the developing roller 34. The feeding roller 35 may include a metal shaft and an electrically-semiconductive foamed silicon sponge layer that covers an outer peripheral surface of the metal shaft, for example. The feeding roller 35 may be a so-called sponge roller, for example. The feeding roller 35 may be so pressed against the developing roller 34 as to be in contact with the developing roller 34.

[Developing Blade]

The developing blade 36 may mainly control the thickness of the toner fed to the surface of the developing roller 34. The developing blade 36 may be disposed at a position away from the developing roller 34 with a predetermined distance, i.e., predetermined spacing, in between, for example. The thickness of the toner may be controlled on the basis of the distance, i.e., the spacing, between the developing roller 34 and the developing blade 36. The developing blade 36 may include one or more of metal materials such as stainless steel, for example.

[Cleaning Blade]

The cleaning blade 37 may be a plate-like elastic member that mainly scrapes off unnecessary remains of the toner that are present on the surface of the photosensitive drum 32. The cleaning blade 37 may extend in a direction substantially parallel to a direction in which the photosensitive drum 32 extends, for example. The cleaning blade 37 may be so pressed against the photosensitive drum 32 as to be in contact with the photosensitive drum 32. The cleaning blade 37 may include one or more of polymer materials such as urethane rubber, for example.

[Cartridge]

The cartridge 38 may be a container that mainly contains the toner. The type of the toner contained in the cartridge 38 may be as described above, for example.

[Light Source]

The light source 39 may be an exposure device that mainly performs exposure on the surface of the photosensitive drum 32 to thereby form the electrostatic latent image on the surface of the photosensitive drum 32. The light source 39 may be, for example, a light-emitting diode (LED) head, and include components such as an LED element and a lens array. The LED element and the lens array may be so disposed that the light outputted from the LED element forms an image on the surface of the photosensitive drum 32, for example.

[1-3. Block Configuration]

A description is given next of a block configuration of the image forming apparatus.

FIG. 3 illustrates an example of the block configuration of the image forming apparatus, and includes together some of the components of the image forming apparatus that have been already described.

Referring to FIG. 3, the image forming apparatus may include a controller 71, an interface (I/F) controller 72, a reception memory 73, an editing memory 74, a panel section 75, an operation section 76, various sensors 77, a light source controller 78, a charge voltage controller 79, a development voltage controller 80, a feed voltage controller 81, a transfer voltage controller 82, a roller drive controller 83, a drum drive controller 84, a movement controller 85, a belt drive controller 86, and a fixing controller 87, for example.

[Controller]

The controller 71 may mainly control an overall operation of the image forming apparatus. The controller 71 may include a component such as a control circuit, a memory, an input-output port, or a timer. The control circuit may include a component such as a central processing unit (CPU). The memory may include one or more of storage devices such as a read-only memory (ROM) and a random-access memory (RAM), for example.

For example, the controller 71 may control a positional relationship between the dyeing-target toner image Z1 formed by the developing unit 30F and the textile printing toner image Z2 formed by the developing units 30Y, 30M, 30C, and 30K. The dyeing-target toner image Z1 and the textile printing toner image Z2 may be described later with reference to FIGS. 4 and 5.

For example, when the intermediate transfer belt 41 is used to form an image, the controller 71 may dispose the dyeing-target toner image Z1 and the textile printing toner image Z2 in this order on the intermediate transfer belt 41, as will be described later with reference to FIG. 4. In this case, the dyeing-target toner image Z1 may be disposed on side closer to the intermediate transfer belt 41 and the textile printing toner image Z2 may be disposed on side farther from the intermediate transfer belt 41. The developing units 30, i.e., the developing units 30F, 30Y, 30M, 30C, and 30K, the transfer section 40, and the controller 71 may correspond to an "image forming section" in one specific but non-limiting embodiment of the technology.

One reason why the controller 71 disposes the dyeing-target toner image Z1 and the textile printing toner image Z2 in this order on the intermediate transfer belt 41 is that the controller 71 may eventually cause the textile printing toner image Z2 and the dyeing-target toner image Z1 to be disposed in this order on the print medium M as will be described later with reference to FIG. 5. In this case, the textile printing toner image Z2 may be disposed on side closer to the print medium M and the dyeing-target toner image Z1 may be disposed on side farther from the print medium M.

[I/F Controller]

The I/F controller 72 may mainly receive information such as data transmitted from an external device to the image forming apparatus. The external device may be one or more of devices such as a personal computer that is usable by a user of the image forming apparatus, for example. The information transmitted from the external device to the image forming apparatus may be image data directed to formation of the image, for example.

[Reception Memory and Editing Memory]

The reception memory 73 may mainly store information such as data received by the image forming apparatus. The editing memory 74 may mainly store data such as the image data that has been stored in the reception memory 73 and subjected to an editing process.

[Panel Section and Operation Section]

The panel section 75 may include a component such as a display panel. The display panel may display information necessary for the user to operate the image forming apparatus. The display panel is not particularly limited in its type; however, the display panel may be a liquid crystal panel or any other suitable panel, for example. The operation section 76 may include a component such as a button that is to be operated by the user upon the operation of the image forming apparatus.

[Various Sensors]

The various sensors 77 may include one or more sensors such as a temperature sensor, a humidity sensor, an image density sensor, a medium position detector, a remaining toner amount detector, and a motion detector, for example.

[Light Source Controller, Charge Voltage Controller, Development Voltage Controller, Feed Voltage Controller, and Transfer Voltage Controller]

The light source controller 78 may mainly control an exposure operation of the light source 39 or any other operation, for example. The charge voltage controller 79 may mainly control a voltage to be applied to the charging roller 33 or any other voltage, for example. The development voltage controller 80 may mainly control a voltage to be applied to the developing roller 34 or any other voltage, for example. The feed voltage controller 81 may mainly control a voltage to be applied to the feeding roller 35 or any other voltage, for example. The transfer voltage controller 82 may mainly control a voltage to be applied to each of the primary transfer roller 45 and the secondary transfer roller 46, or any other voltage, for example. The foregoing voltages may each be settable in accordance with an instruction given by the controller 71, and may each be variable to any voltage in accordance with the instruction given by the controller 71.

Although simplified in FIG. 3, the image forming apparatus in one embodiment may include five light source controllers 78 corresponding to the five developing units 30, i.e., the developing units 30F, 30Y, 30M, 30C, and 30K. In one example, the image forming apparatus may include the light source controller 78 that controls the light source 39 attached to the developing unit 30F, the light source controller 78 that controls the light source 39 attached to the developing unit 30Y, the light source controller 78 that controls the light source 39 attached to the developing unit 30M, the light source controller 78 that controls the light source 39 attached to the developing unit 30C, and the light source controller 78 that controls the light source 39 attached to the developing unit 30K.

The description above regarding the light source controller 78 may be similarly applicable to each of the charge voltage controller 79, the development voltage controller 80, the feed voltage controller 81, and the transfer voltage controller 82, for example. In one example, the image forming apparatus may include, for the respective five developing units 30, the five charge voltage controllers 79, the five development voltage controllers 80, the five feed voltage controllers 81, and the five transfer voltage controllers 82, for example.

[Roller Drive Controller, Drum Drive Controller, Movement Controller, Belt Drive Controller, and Fixing Controller]

The roller drive controller 83 may mainly control rotation operations of a series of rollers or any other operation by means of the roller motor 88, for example. The series of rollers may include the charging roller 33, the developing roller 34, the feeding roller 35, the primary transfer roller 45, and the secondary transfer roller 46. The drum drive controller 84 may mainly control a rotation operation of the photosensitive drum 32 or any other operation by means of the drum motor 89, for example. The movement controller 85 may mainly control a moving operation of the developing unit 30 or any other operation by means of the movement motor 90, for example. The belt drive controller 86 may mainly control a moving operation of the intermediate transfer belt 41 or any other operation by means of the belt motor 91, for example. The fixing controller 87 may mainly control an operation of the heater 92 on the basis of temperature measured by the thermistor 93. Further, the fixing controller 87 may also mainly control a rotation operation of each of the heating roller 51 and the pressure-applying roller 52 by means of the fixing motor 94, for example.

The description above regarding the light source controller 78 may be similarly applicable to each of the roller drive controller 83, the drum drive controller 84, and the movement controller 85, for example. In one example, the image forming apparatus may include, for the respective five developing units 30, the five roller drive controllers 83, the five drum drive controllers 84, and the five movement controllers 85, for example.

[1-4. Configuration of Toner]

A description is given next of a configuration of the toner.

The toner described below may be a negatively-charged toner for a single component development, for example. In other words, the toner may have a negatively-charged polarity, for example.

The single component development provides the toner itself with an appropriate amount of electric charge and thereby applies an electric charge to the toner without using a carrier, e.g., a magnetic particle. In contrast, a two component development provides a mixture of the foregoing carrier and the toner and thereby applies an electric charge to the toner by utilizing friction between the foregoing carrier and the toner.

A method of manufacturing the toner is not particularly limited. Non-limiting examples of the method of manufacturing the toner may include pulverization or polymerization. Two or more of the foregoing methods may be used in any combination. Non-limiting examples of the polymerization may include an emulsion polymerization aggregation method or a solution suspension method.

[Dyeing-Target Toner]

The dyeing-target toner may have properties of being dyed with the textile printing dye included in the textile printing toner, as described above. In other words, the dyeing-target toner may be a receptor that receives the textile printing dye moving from the textile printing toner utilizing thermal energy H, illustrated in FIG. 11, supplied to the textile printing toner, as will be described later. The reception of the textile printing dye by the dyeing-target toner allows for dyeing of the dyeing-target toner with the textile printing dye.

The dyeing-target toner may include, for example, one or more of polymer compounds. The polymer compounds may have properties of being dyed with the textile printing dye. Non-limiting examples of the polymer compounds may include polyester-based resin, styrene-acrylic-based resin, epoxy-based resin, or styrene-butadiene-based resin.

As used herein, the term "polyester-based resin" collectively refers to polyester and a derivative thereof. In other words, the wording "-based" of the term "polyester-based resin" indicates that the term encompasses not only polyester but also the derivative thereof. The usage of the wording "-based" is similarly applicable to other terms such as the "styrene-acrylic-based resin", the "epoxy-based resin", and the "styrene-butadiene-based resin".

For example, the polymer compound may include the polyester-based resin. One reason for this is that this makes it easier for the dyeing-target toner to be dyed with the textile printing dye. Another reason for this is that the polyester-based resin has high affinity for the print medium M such as paper, and the dyeing-target toner including the polyester-based resin is therefore more easily fixed to the print medium M. Still another reason for this is that the polyester-based resin has high affinity for the non-print medium L such as fabric, and the dyeing-target toner including the polyester-based resin is therefore more easily fixed to the non-print medium L. Still another reason for this is that the polyester-based resin has high physical strength even with a relatively-small molecular weight, and the dyeing-target toner including the polyester-based resin therefore has high durability. Still another reason for this is that the dyeing-target toner is more easily fixed to the print medium M even in a case where the dyeing-target toner has low electric charge characteristics.

The polyester-based resin is not particularly limited in its crystalline state. Therefore, the polyester-based resin may be crystalline polyester, amorphous polyester, or both. In one example, the polyester-based resin may be the crystalline polyester. One reason for this is that the dyeing-target toner is thereby more easily dyed with the textile printing dye. Another reason for this is that the dyeing-target toner is thereby more easily fixed to the print medium M, and the durability of the dyeing-target toner is thereby improved.

The polyester-based resin may be a reactant (a condensation polymer) of one or more alcohols and one or more carboxylic acids, for example.

The type of the alcohol is not particularly limited. In one example, the alcohol may be a dihydric or polyhydric alcohol or a derivative thereof. Non-limiting examples of the dihydric or polyhydric alcohol may include ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, or glycerin.

The type of the carboxylic acid is not particularly limited. In one example, however, the carboxylic acid may be a divalent or multivalent carboxylic acid or a derivative thereof. Non-limiting examples of the divalent or multivalent carboxylic acid may include maleic acid, fumaric acid, phthalic acid, isophthalic acid, terephthalic acid, succinic acid, adipic acid, trimellitic acid, pyromellitic acid, cyclopentane dicarboxylic acid, succinic anhydride, trimellitic anhydride, maleic anhydride, or dodecenylsuccinic anhydride.

The dyeing-target toner is not particularly limited in its color. The dyeing-target toner may therefore include a colorant as with the textile printing toner, or may include no colorant unlike the textile printing toner. The colorant included in the dyeing-target toner may have dying properties as with the colorant, i.e., the textile printing dye, included in the textile printing toner. Alternatively, the colorant included in the dyeing-target toner may have no dying property unlike the colorant included in the textile printing toner.

When the dyeing-target toner include no colorant, the dyeing-target toner may be colorless or transparent. The colorless dyeing-target toner may be a so-called clear toner, for example. In this case, the dyeing-target toner image Z1 may be colorless. Therefore, a hue of the dyeing-target toner image Z1 hardly influences a hue of the textile printing toner image Z2.

When the dyeing-target toner includes a colorant with no dying property, the color of the dyeing-target toner is not particularly limited. Accordingly, the color of the dyeing-target toner may be yellow, magenta, cyan, black, white, or a mixture of two or more thereof, for example. In this case, the dyeing-target toner may include, for example, a colorant of a color corresponding to the color of the dyeing-target toner, and the colorant may include, for example, one or more of pigments and dyes. For example, a white dyeing-target toner may include a pigment such as titanium oxide.

In one example, the color of the dyeing-target toner may allow the hue of the dyeing-target toner image Z1 to influence less the hue of the textile printing toner image Z2. Therefore, in one example, the color of the dyeing-target toner may be white. It is to be noted that, however, the color of the dyeing-target toner is not particularly limited to white as long as the hue of the dyeing-target toner image Z1 influences less the hue of the textile printing toner image Z2. For example, the color of the dyeing-target toner may be pale gray.

When the dyeing-target toner includes a colorant having the dying properties, the color of the dyeing-target toner is not particularly limited. Accordingly, the color of the dyeing-target toner may be yellow, magenta, cyan, black, white, or a mixture of two or more thereof, as with the case where the dyeing-target toner includes the colorant with no dying property. In this case, the dyeing-target toner may include, for example, a colorant of a color corresponding to the color of the dyeing-target toner, and the colorant may include, for example, one or more of dyes having dying properties, i.e., textile printing dyes. Details of the textile printing dye of each color may be similar to those of the colorant included in the textile printing toner, i.e., the textile printing dye, which will be described later.

In one example, the color of the dyeing-target toner may allow the hue of the dyeing-target toner image Z1 to influence less the hue of the textile printing toner image Z2, as described above. Therefore, in one example, the dyeing-target toner may be colorless or transparent, or have a color of white. Further, in one example, the dyeing-target toner may be colorless. In other words, in one example, the dyeing-target toner may be colorless as the dyeing-target toner includes no colorant.

The dyeing-target toner may further include, however, one or more other materials such as an additive. The other materials are not particularly limited in their types: however, non-limiting examples of the other materials may include an external additive, a release agent, an electric charge control agent, an electric conductivity modifier, a reinforcement filler, an antioxidant, an anti staling agent, a flow improver, or a cleaning improver.

The external additive may mainly suppress a phenomenon such as aggregation in the toner, and thereby improve fluidity of the toner. The external additive may include one or more materials such as an inorganic material or an organic material, for example. Non-limiting examples of the inorganic material may include hydrophobic silica. Non-limiting examples of the organic material may include melamine resin.

A content of the external additive is not particularly limited. In one example, however, the content of the external additive may be from about 0.01 parts by weight to about 10 parts by weight relative to about 100 parts by weight of the polymer compound. In another example, the content of the external additive may be from about 0.05 parts by weight to about 8 parts by weight relative to about 100 parts by weight of the polymer compound.

The release agent may mainly improve characteristics, of the toner, such as fixing characteristics or offset resistance. The release agent may include one or more of waxes such as aliphatic-hydrocarbon-based wax, an oxide of aliphatic-hydrocarbon-based wax, fatty-acid-ester-based wax, or a deoxide of fatty-acid-ester-based wax. Other than the waxes described above, the release agent may also be a block copolymer of any of the foregoing series of waxes, for example.

Non-limiting examples of the aliphatic-hydrocarbon-based wax may include low-molecular polyethylene, low-molecular polypropylene, a copolymer of olefin, microcrystalline wax, paraffin wax, or Fischer-Tropsch wax. Non-limiting examples of the oxide of aliphatic-hydrocarbon-based wax may include oxidized polyethylene wax. Non-limiting examples of the fatty-acid-ester-based wax may include carnauba wax or montanic acid ester wax. The deoxide of fatty-acid-ester-based wax may be partially-deoxidized or fully-deoxidized fatty-acid-ester-based wax. Non-limiting examples of the deoxide of fatty-acid-ester-based wax may include deoxidized carnauba wax.

A content of the release agent is not particularly limited. In one example, however, the content of the release agent may be from about 0.1 parts by weight to about 20 parts by weight relative to about 100 parts by weight of the polymer compound. In another example, the content of the release agent may be from about 0.5 parts by weight to about 12 parts by weight relative to about 100 parts by weight of the polymer compound.

The electric charge control agent may mainly control characteristics such as triboelectric charging characteristics of the toner. The electric charge control agent to be used for the negatively-charged toner may include one or more materials such as an azo-based complex, a salicylic-acid-based complex, or a calixarene-based complex, for example.

A content of the electric charge control agent is not particularly limited. In one example, however, the content of the electric charge control agent may be from about 0.05 parts by weight to about 15 parts by weight relative to about 100 parts by weight of the polymer compound.

[Textile Printing Toner (Yellow Textile Printing Toner, Magenta Textile Printing Toner, Cyan Textile Printing Toner, and Black Textile Printing Toner)]

Each of the yellow textile printing toner, the magenta textile printing toner, the cyan textile printing toner, and the black textile printing toner may include the textile printing dye of the corresponding color. For example, the yellow textile printing toner, the magenta textile printing toner, the cyan textile printing toner, and the black textile printing toner may include the yellow textile printing dye, the magenta textile printing dye, the cyan textile printing dye, and the black textile printing dye, respectively.

For example, the yellow textile printing toner may have a configuration similar to that of the dyeing-target toner except that the yellow textile printing toner may include as the colorant, one or more of the yellow textile printing dyes and include one or more of binder resins in place of the polymer compound. Non-limiting examples of the yellow textile printing dye may include C. L Reactive Yellow 2, C. L Disperse Yellow 54, Disperse Yellow 160, or C. L Yellow 114. Non-limiting examples of the binder resin may include polyester-based resin, styrene-acrylic-based resin, epoxy-based resin, or styrene-butadiene-based resin.

Unlike the dyeing-target toner, the yellow textile printing toner may not necessarily include the release agent. In this case, the textile printing toner and the dyeing-target toner may have thermophysical characteristics, e.g., endothermic characteristics, different from each other mainly as a result of a difference in whether the release agent is included. The difference in endothermic characteristics will be described later.

A content of the yellow textile printing dye is not particularly limited. In one example, the content of the yellow textile printing dye may be from about 2 parts by weight to about 25 parts by weight relative to about 100 parts by weight of the binder resin. In another example, the content of the yellow textile printing dye may be from about 2 parts by weight to about 15 parts by weight relative to about 100 parts by weight of the binder resin. A content of the release agent is not particularly limited. In one example, the content of the release agent may be from about 0.1 parts by weight to about 20 parts by weight relative to about 100 parts by weight of the binder resin. In another example, the content of the release agent may be from about 0.5 parts by weight to about 12 parts by weight relative to about 100 parts by weight of the binder resin. A content of the electric charge control agent is not particularly limited. In one example, the content of the electric charge control agent may be from about 0.05 parts by weight to about 15 parts by weight relative to about 100 parts by weight of the binder resin. A content of the external additive is not particularly limited. In one example, the content of the external additive may be from about 0.01 parts by weight to about 10 parts by weight relative to about 100 parts by weight of the binder resin. In another example, the content of the external additive may be from about 0.05 parts by weight to about 8 parts by weight relative to about 100 parts by weight of the binder resin.

The magenta textile printing toner may have, for example, a configuration similar to that of the yellow textile printing toner except that the magenta textile printing toner may include the magenta textile printing dye in place of the yellow textile printing dye. Non-limiting examples of the magenta textile printing dye may include C. L Reactive Red 3, C. L Disperse Red 50, or C. L Disperse Red 92. A content of the magenta textile printing dye may be similar to that of the yellow textile printing dye, for example.

The cyan textile printing toner may have, for example, a configuration similar to that of the yellow textile printing toner except that the cyan textile printing toner may include the cyan textile printing dye in place of the yellow textile printing dye. Non-limiting examples of the cyan textile printing dye may include C. L Disperse Blue 60, C. L Reactive Blue 15, C. L Disperse Blue 359, C. L Solvent Blue 63, C. L Disperse Blue 165, or Cibacron Turquoise Blue FGF-P. A content of the cyan textile printing dye may be similar to that of the yellow textile printing dye, for example.

The black textile printing toner may have, for example, a configuration similar to that of the yellow textile printing toner except that the black textile printing toner may include the black textile printing dye in place of the yellow textile printing dye. Non-limiting examples of the black textile printing dye may include C. L Reactive Black 5. It is to be noted that the black textile printing dye may be a mixture of the yellow textile printing dye, the magenta textile printing dye, and the cyan textile printing dye in one example. A content of the black textile printing dye may be similar to that of the yellow textile printing dye, for example.

[1-5. Operation]

A description is given next of an operation of the image forming apparatus.

Figure 6:
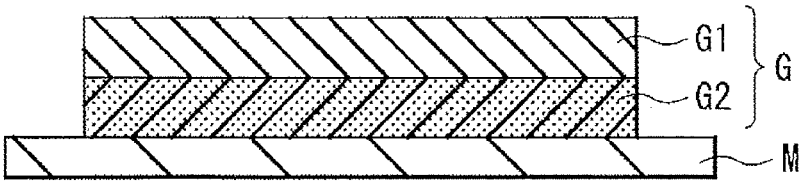
FIG. 6 is a cross-sectional view of an example of a configuration of the print medium on which an image including a textile printing image and a dyeing-target image is formed.

FIG. 4 illustrates a cross-sectional configuration of the intermediate transfer belt 41 on which the dyeing-target toner image Z1 and the textile printing toner image Z2 are formed. FIG. 5 illustrates a cross-sectional configuration of the print medium M on which the textile printing toner image Z2 and the dyeing-target toner image Z1 are formed. FIG. 6 illustrates a cross-sectional configuration of the print medium M on which an image G including a textile printing image G2 and a dyeing-target image G1 is formed.

In each of FIGS. 4 and 5, the textile printing toner image Z2 is hatched for a purpose of easy differentiation between the dyeing-target toner image Z1 and the textile printing toner image Z2. In FIG. 6, the textile printing image G2 is hatched for a purpose of easy differentiation between the dyeing-target image G1 and the textile printing image G2.

In a case of forming the image G on the print medium M, the image forming apparatus may perform a developing process, a primary transfer process, a secondary transfer process, and a fixing process in this order, and may perform a cleaning process on an as-needed basis, as described below, for example. The series of operations performed by the image forming apparatus described below may be controlled by the controller 71 described above with reference to FIG. 3.

[Developing Process]

First, the print medium M contained in the tray 10 may be picked up by the feeding roller 20. The print medium M picked up by the feeding roller 20 may be conveyed by the conveying rollers 61 and 62 along the conveyance route R1 in a direction indicated by an arrow F1.

The developing process may involve the operation performed in the developing unit 30F as described below. In the developing unit 30F, the charging roller 33 may apply a direct-current voltage to the surface of the photosensitive drum 32 while rotating in accordance with the rotation of the photosensitive drum 32. The surface of the photosensitive drum 32 may be thereby evenly charged.

Thereafter, the light source 39 may apply light to the surface of the photosensitive drum 32 on the basis of the image data that has been subjected to the editing process. A surface potential in a region, of the surface of the photosensitive drum 32, in which the light is applied is thereby attenuated. An electrostatic latent image may be thus formed on the surface of the photosensitive drum 32.

In the developing unit 30F, the dyeing-target toner contained in the cartridge 38 may be discharged toward the feeding roller 35.

The feeding roller 35 may rotate upon receiving application of a voltage. The dyeing-target toner may be thereby fed from the cartridge 38 to the surface of the feeding roller 35.

The developing roller 34 may rotate while being so pressed against the feeding roller 35 as to be in contact with the feeding roller 35, upon receiving application of a voltage. The dyeing-target toner fed to the surface of the feeding roller 35 may be thereby attached to the surface of the developing roller 34, whereby the dyeing-target toner may be conveyed by utilizing the rotation of the developing roller 34. In this case, the dyeing-target toner attached to the surface of the developing roller 34 may be partially removed by the developing blade 36, whereby the dyeing-target toner attached to the surface of the developing roller 34 may be caused to have an even thickness.

After the photosensitive drum 32 rotates while being so pressed against the developing roller 34 as to be in contact with the developing roller 34, the dyeing-target toner attached to the surface of the developing roller 34 may be moved onto the surface of the photosensitive drum 32. The dyeing-target toner may be thereby attached to the surface of the photosensitive drum 32, i.e., to the electrostatic latent image.

[Primary Transfer Process]

In the transfer section 40, when the driving roller 42 rotates, each of the driven roller 43 and the backup roller 44 may rotate in accordance with the rotation of the driving roller 42. This may cause the intermediate transfer belt 41 to travel in the direction indicated by the arrow F5.

The primary transfer process may involve application of a voltage to the primary transfer roller 45F. The primary transfer roller 45F may be so pressed against the photosensitive drum 32 as to be in contact with the photosensitive drum 32 with the intermediate transfer belt 41 in between. Therefore, the dyeing-target toner that has been attached to the surface, i.e., to the electrostatic latent image, of the photosensitive drum 32 in the foregoing developing process may be transferred onto the surface of the intermediate transfer belt 41.

The dyeing-target toner image Z1 including the dyeing-target toner may be thereby formed on the surface of the intermediate transfer belt 41, as illustrated in FIG. 4.

Thereafter, the intermediate transfer belt 41 onto which the dyeing-target toner has been transferred may continue to travel in the direction indicated by the arrow F5. This may allow each of the set of the developing unit 30Y and the primary transfer roller 45Y, the set of the developing unit 30M and the primary transfer roller 45M, the set of the developing unit 30C and the primary transfer roller 45C, and the set of the developing unit 30K and the primary transfer roller 45K to perform the developing process and the primary transfer process by a procedure similar to the foregoing procedure performed by the developing unit 30F and the primary transfer roller 45F. Thereby, the yellow textile printing toner, the magenta textile printing toner, the cyan textile printing toner, and the black textile printing toner may be transferred onto the surface of the intermediate transfer belt 41.

In one example, the developing unit 30Y and the primary transfer roller 45Y may transfer the yellow textile printing toner onto the surface of the intermediate transfer belt 41. The developing unit 30M and the primary transfer roller 45M may transfer the magenta textile printing toner onto the surface of the intermediate transfer belt 41. The developing unit 30C and the primary transfer roller 45C may transfer the cyan textile printing toner onto the surface of the intermediate transfer belt 41. The developing unit 30K and the primary transfer roller 45K may transfer the black textile printing toner onto the surface of the intermediate transfer belt 41.

The textile printing toner image Z2 including the textile printing toner, e.g., the yellow textile printing toner, the magenta textile printing toner, the cyan textile printing toner, and the black textile printing toner, may be thereby formed on the dyeing-target toner image Z1 formed on the surface of the intermediate transfer belt 41, as illustrated in FIG. 4. In other words, the dyeing-target toner image Z1 and the textile printing toner image Z2 may be disposed in this order on the intermediate transfer belt 41.

It is to be noted that whether each of the developing process and the primary transfer process is actually performed by the respective developing units 30Y, 30M, 30C, and 30K and the primary transfer rollers 45Y, 45M, 45C, and 45K may be determined depending on the color or the combination of colors that is necessary for the formation of the textile printing toner image Z2.

[Secondary Transfer Process]

The print medium M may pass between the backup roller 44 and the secondary transfer roller 46 upon being conveyed along the conveyance route R1.

The secondary transfer process may involve application of a voltage to the secondary transfer roller 46. The secondary transfer roller 46 may be so pressed against the backup roller 44 as to be in contact with the backup roller 44 with the print medium M in between. Therefore, the toners, e.g., the dyeing-target toner, the yellow textile printing toner, the magenta textile printing toner, the cyan textile printing toner, and the black textile printing toner, that have been transferred onto the intermediate transfer belt 41 in the foregoing primary transfer process may be transferred onto the print medium M.

The textile printing toner image Z2 and the dyeing-target toner image Z1 may be thereby disposed in this order on the print medium M, as illustrated in FIG. 5.

[Fixing Process]

After the toner has been transferred onto the print medium M in the secondary transfer process, the print medium M may be continuously conveyed along the conveyance route R1 in the direction indicated by the arrow F1. The print medium M may be thus conveyed to the fixing section 50.

In the fixing process, the surface temperature of the heating roller 51 may be so controlled as to be predetermined temperature. When the pressure-applying roller 52 rotates while being so pressed against the heating roller 51 as to be in contact with the heating roller 51, the print medium M may be so conveyed as to pass between the heating roller 51 and the pressure-applying roller 52.

The toner that has been transferred onto the surface of the print medium M may be thereby heated, which may cause the toner to be molten. Further, the molten toner may be so pressed against the print medium M as to be in contact with the print medium M. This may cause the toner to be firmly attached to the print medium M.

The toner may be thereby fixed to the print medium M, resulting in formation of the image G on the surface of the print medium M, as illustrated in FIG. 6. The image G may include the dyeing-target image G1 formed as a result of the fixing process performed on the dyeing-target toner image Z1, and the textile printing image G2 formed as a result of the fixing process performed on the textile printing toner image Z2. In other words, the textile printing image G2 and the dyeing-target image G1 may be disposed in this order on the print medium M.

Figure 11:
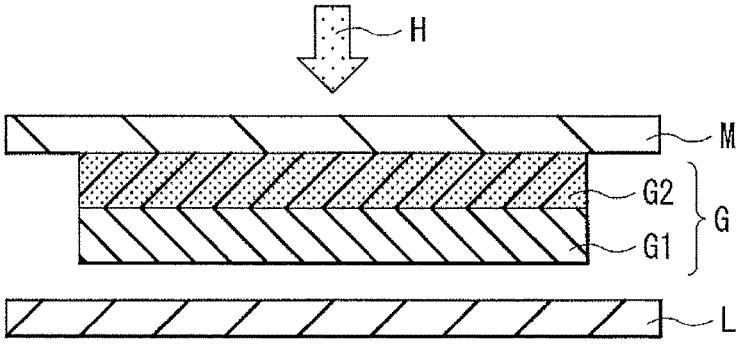
FIG. 11 is a cross-sectional view describing an example of a method of transferring, onto a non-print medium, the image formed by the image forming apparatus according to one example embodiment of the technology.

It is to be noted that the image G formed on the print medium M may be transferable onto the non-print medium L, other than the print medium M, illustrated in FIG. 11. The transfer of the image G from the print medium M onto the non-print medium L may be performed, for example, by utilizing the properties of the textile printing dye that allow the textile printing dye to move to the non-print medium L when the textile printing dye is heated. For such a reason, when the image G is formed on the print medium M, the image G may be formed, for example, in a state laterally reversed from a state of the image transferred onto the non-print medium L. This allows the image G to be transferred onto the non-print medium L with an appropriate direction.

The print medium M on which the image G has been formed may be conveyed by the conveying rollers 63 and 64 along the conveyance route R2 in a direction indicated by an arrow F2. The print medium M may thus be discharged from the discharge opening 1H to the stacker 2.

It is to be noted that the procedure of conveying the print medium M may be changed in accordance with the manner by which the image is to be formed on the print medium M.

For example, in a case where images are to be formed on both sides of the print medium M, the print medium M that has passed the fixing section 50 may be conveyed by the conveying rollers 65 to 68 along the conveyance routes R3 to R5 in directions indicated by respective arrows F3 and F4, and be thereafter conveyed again by the conveying rollers 61 and 62 along the conveyance route R1 in the direction indicated by the arrow F1. In this case, the direction in which the print medium M is to be conveyed may be controlled by the conveyance path switching guides 69 and 70. This may allow the back surface of the print medium M, i.e., the surface on which no image has been formed yet, to be subjected to the developing process, the primary transfer process, the secondary transfer process, and the fixing process.

[Cleaning Process]

Unnecessary remains of the toner may sometimes be present on the surface of the photosensitive drum 32 in the developing unit 30. The unnecessary remains of the toner may be part of the toner that has been used in the primary transfer process, which may be the toner that has remained on the surface of the photosensitive drum 32 without being transferred onto the intermediate transfer belt 41, for example.

To address this, the photosensitive drum 32 may rotate while being so pressed against the cleaning blade 37 as to be in contact with the cleaning blade 37 in the developing unit 30. This may cause the remains of the toner present on the surface of the photosensitive drum 32 to be scraped off by the cleaning blade 37. As a result, the unnecessary remains of the toner may be removed from the surface of the photosensitive drum 32.

Further, in the transfer section 40, part of the toner that has been moved onto the surface of the intermediate transfer belt 41 in the primary transfer process may sometimes not be moved onto the surface of the print medium M in the secondary transfer process and may remain on the surface of the intermediate transfer belt 41.

To address this, the cleaning blade 47 may scrape off the remains of the toner on the surface of the intermediate transfer belt 41 in the transfer section 40 upon traveling of the intermediate transfer belt 41 in the direction indicated by the arrow F5. As a result, the unnecessary remains of the toner may be removed from the surface of the intermediate transfer belt 41.

[1-6. Example Workings and Example Effects]

In the image forming apparatus according to the first example embodiment, each of the developing units 30Y, 30M, 30C, and 30K may form the textile printing toner image Z2 with the textile printing toner, and the developing unit 30F may form the dyeing-target toner image Z1 with the dyeing-target toner. The textile printing toner image Z2 and the dyeing-target toner image Z1 may be thereby disposed in this order on the print medium M. As a result, when the image G formed on the print medium M is transferred onto the non-print medium L such as fabric, an image I with higher quality is formed on the non-print medium L, for example, for the following reasons.

Figure 7:
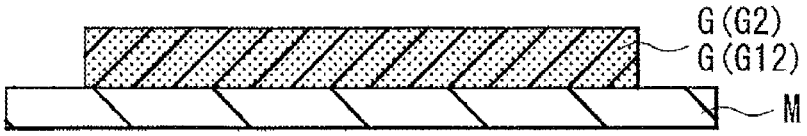
FIG. 7 RELATED ART
FIG. 7 is a cross-sectional view of an example of a configuration of a print medium on which an image including a textile printing image is formed by an image forming apparatus according to a comparative example.

FIG. 7 illustrates a cross-sectional configuration of the print medium M on which the image G is formed by an image forming apparatus according to a comparative example, and corresponds to FIG. 6. The image forming apparatus according to the comparative example has a configuration similar to that of the image forming apparatus according to the first example embodiment and operates in a manner similar to that of the image forming apparatus according to the first example embodiment, except that the image forming apparatus according to the comparative example does not include the developing unit 30F and therefore the image G includes only the textile printing image G2.

An example application of the image G formed on the print medium M by the textile printing toner may be to form the image I corresponding to the image G on the non-print medium L by transferring the image G onto the non-print medium L, such as fabric, illustrated in FIG. 11, as will be described later. A method of forming the image may be, for example, so-called T-shirt printing when the non-print medium L is a T-shirt.

The image G formed on the print medium M by the image forming apparatus according to the comparative example includes the textile printing image G2, as illustrated in FIG. 7. Therefore, the image G includes the textile printing toner. Accordingly, when the print medium M is heated while the print medium M is closely attached to the non-print medium L, the textile printing dye included in the image G or the textile printing toner is moved to the non-print medium L. The non-print medium L is thereby dyed with the textile printing dye, and the image G is transferred onto the non-print medium L as a result. In this case, when the image G includes a material such as the binder resin together with the textile printing toner, the material such as the binder resin remains on the print medium M and only the textile printing dye is moved from the print medium M to the non-print medium L. As a result, the image I is formed on the non-print medium L.

Depending on the material of the non-print medium L, however, it may be more difficult for the textile printing dye included in the textile printing toner to be moved to the non-print medium L, and it may be more difficult for the non-print medium L to be dyed with the textile printing dye. This may result in a decrease in efficiency of transferring the image G from the print medium M onto the non-print medium L. Further, depending on the material of the non-print medium L, it may be easier for part of the textile printing dye to pass through each of the print medium M and the non-print medium L when the textile printing dye is moved to the non-print medium L. The efficiency of transferring the image G from the print medium M onto the non-print medium L may be decreased also in this point of view. In this case, the image G transferred onto the non-print medium L may have insufficient density, which may lead to a decrease in color reproducibility and a decrease in clearness of an outline of the image. For such reasons, it is difficult to form the image I with higher quality on the non-print medium L.

In contrast, the image G formed on the print medium M by the image forming apparatus according to the first example embodiment may include the textile printing image G2 including the textile printing toner and the dyeing-target image G1 including the dyeing-target toner and formed on the textile printing image G2, as illustrated in FIG. 6. Accordingly, when the print medium M is heated while the print medium M is closely attached to the non-print medium L, the textile printing dye included in the textile printing image G2 or the textile printing toner may be moved to the dyeing-target image G1. The dyeing-target image G1 or the dyeing-target toner may be thereby dyed with the textile printing dye. Further, the dyeing-target image G1 dyed with the textile printing dye may be transferred onto the non-print medium L by being separated from the textile printing image G2. In other words, the dyeing-target image G1 being dyed with the textile printing dye may be moved from the print medium M to the non-print medium L. It is therefore more difficult for part of the textile printing dye to pass through the non-print medium L owing to the presence of the dyeing-target image G1. As a result, the image I may be formed on the non-print medium L.

In this case, the textile printing dye may be moved to the non-print medium L together with the dyeing-target image G1. Therefore, on a condition that it is easier for the dyeing-target image G1 to be moved to the non-print medium L, it is easier for the non-print medium L to be dyed with the textile printing dye, irrelevant of whether the non-print medium L itself is easily dyed with the textile printing dye. Further, an amount of loss of the textile printing dye resulting from passing of the textile printing dye through the non-print medium L is decreased. Accordingly, the efficiency of transferring the image G from the print medium M to the non-print medium L is increased. This secures the density of the image G transferred onto the non-print medium L, which results in an improvement in color reproducibility and an improvement in clearness of the outline of the image. Hence, it is possible to form the image I with higher quality on the non-print medium L. In other words, it is possible to form, on the print medium M, the image G with higher quality that allows for achievement of the image I with higher quality.

According to the first example embodiment, the print medium M is not particularly limited in its type as long as the textile printing image G2 including the textile printing toner is allowed to be fixed to the print medium M. Further, the non-print medium L is not particularly limited in its type as long as the dyeing-target image G1 including the polymer compound is allowed to be fixed to the non-print medium L. Hence, it is possible to increase freedom regarding the type or the material of the print medium M, and to increase freedom regarding the type or the material of the non-print medium L.

Moreover, in this case, it is possible to separate the dyeing-target image G1 from the textile printing image G2 in response to the supply of the thermal energy H described above. This eliminates the necessity of separately performing a special process, such as a releasing process, that separates the dyeing-target image G1 from the textile printing image G2. Hence, it is possible to separate the dyeing-target image G1 from the textile printing image G2 more easily and more stably.

Moreover, when the dyeing-target toner, e.g., the polymer compound, includes the polyester-based resin, it is easier for the dyeing-target image G1, i.e., the dyeing-target toner, to be dyed with the textile printing dye, and it is also easier for the dyeing-target image G1 separated from the textile printing image G2 to be transferred onto the non-print medium L. This further improves characteristics such as color reproducibility of the image I formed on the non-print medium L. Hence, it is possible to achieve higher effects.

Moreover, when the dyeing-target toner includes no colorant and is therefore colorless, i.e., when the dyeing-target toner is the so-called clear toner, the hue of the dyeing-target image G1 or the dyeing-target toner image Z1 hardly influences the hue of the textile printing image G2 or the textile printing toner image Z2. This improves color reproducibility of the image G, and therefore improves color reproducibility of the image I as well. Hence, it is possible to achieve higher effects.

Moreover, when the image forming apparatus includes the intermediate transfer belt 41, and the dyeing-target toner image Z1 and the textile printing toner image Z2 are transferred onto the print medium M via the intermediate transfer belt 41, the dyeing-target toner image Z1 and the textile printing toner image Z2 are each formed more stably and are disposed together on the print medium M more stably. This makes it easier for the dyeing-target image G1 to be separated from the textile printing image G2, and also makes it easier for the dyeing-target image G1 separated from the textile printing image G2 to be transferred onto the non-print medium L. Hence, it is possible to achieve higher effects.

Moreover, when the image forming apparatus includes the fixing section 50 that fixes the textile printing toner and the dyeing-target toner to the print medium M, each of the dyeing-target image G1 and the textile printing image G2 is formed more stably. This makes it easier for the dyeing-target image G1 to be separated from the textile printing image G2, and also makes it easier for the dyeing-target image G1 separated from the textile printing image G2 to be transferred onto the non-print medium L. Hence, it is possible to achieve higher effects.

2. IMAGE FORMING APPARATUS (SECOND EXAMPLE EMBODIMENT)

A description is given next of an image forming apparatus according to a second example embodiment of the technology. The components of the first example embodiment that have been already described above will be referred to in the description below where appropriate.

The image forming apparatus according to the first example embodiment may dispose the dyeing-target toner image Z1 and the textile printing toner image Z2 in this order on the intermediate transfer belt 41, and thereafter allow the textile printing toner image Z2 and the dyeing-target toner image Z1 to be disposed in this order on the print medium M. The image forming apparatus according to the first example embodiment may thereby so form the image G that the textile printing image G2 and the dyeing-target image G1 are disposed in this order on the print medium M.

In contrast, the image forming apparatus according to the second example embodiment may dispose a dyeing-target toner image Z11, a textile printing toner image Z12, and a dyeing-target toner image Z13 in this order on the intermediate transfer belt 41, and thereafter allow the dyeing-target toner image Z13, the textile printing toner image Z12, and the dyeing-target toner image Z11 to be disposed in this order on the print medium M. The image forming apparatus according to the second example embodiment may thereby so form the image G that a dyeing-target image G13, a textile printing image G12, and a dyeing-target image G11 are disposed in this order on the print medium M. This will be described later with reference to FIGS. 8 to 10.

A configuration and an operation of the image forming apparatus according to the second example embodiment may be, for example, similar to those of the image forming apparatus according to the first example embodiment except for the following points.

[2-1. Configuration]

Figure 8:
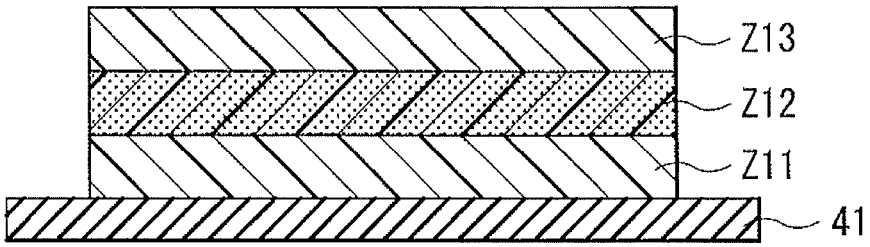
FIG. 8 is a cross-sectional view of an example of a configuration of an intermediate transfer belt on which a dyeing-target toner image, a textile printing toner image, and another dyeing-target toner image are formed by an image forming apparatus according to one example embodiment of the technology.
Figure 9:
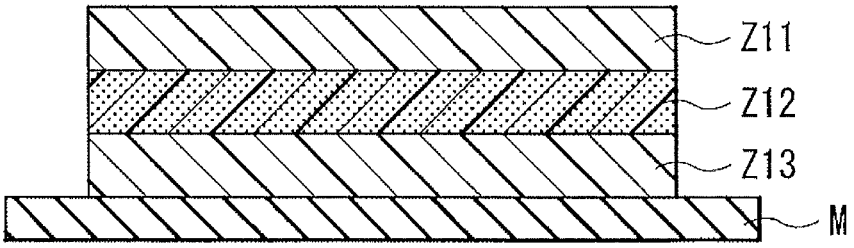
FIG. 9 is a cross-sectional view of an example of a configuration of a print medium on which the dyeing-target toner image, the textile printing toner image, and the other dyeing-target toner image are formed by the image forming apparatus according to one example embodiment of the technology.
Figure 10:
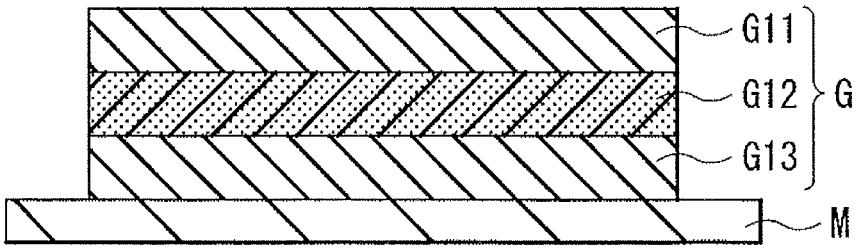
FIG. 10 is a cross-sectional view of an example of a configuration of the print medium on which an image including a dyeing-target image, a textile printing image, and another dyeing-target image is formed by the image forming apparatus according to one example embodiment of the technology.

FIG. 8 illustrates a cross-sectional configuration of the intermediate transfer belt 41 on which the dyeing-target toner image Z11, the textile printing toner image Z12, and the dyeing-target toner image Z13 are formed. FIG. 9 illustrates a cross-sectional configuration of the print medium M on which the dyeing-target toner image Z13, the textile printing toner image Z12, and the dyeing-target toner image Z11 are formed. FIG. 10 illustrates a cross-sectional configuration of the print medium M on which the image G including the dyeing-target image G13, the textile printing image G12, and the dyeing-target image G11 is formed.

In each of FIGS. 8 and 9, the textile printing toner image Z12 is hatched for a purpose of easy differentiation of the textile printing toner image Z12 from the dyeing-target toner images Z11 and Z13. In FIG. 10, the textile printing image G12 is hatched for a purpose of easy differentiation of the textile printing image G12 from the dyeing-target images G11 and G13.

It is to be noted that each of the dyeing-target toner images Z11 and Z13 may have a configuration similar to that of the dyeing-target toner image Z1, and the textile printing toner image Z12 may have a configuration similar to that of the textile printing toner image Z2. Further, each of the dyeing-target images G11 and G13 may have a configuration similar to that of the dyeing-target image G1, and the textile printing image G12 may have a configuration similar to that of the textile printing image G2.

Each of the developing units 30Y, 30M, 30C, and 30K may form the textile printing toner image Z12 by the textile printing toner, e.g., corresponding one of the yellow textile printing toner, the magenta textile printing toner, the cyan textile printing toner, and the black textile printing toner. In contrast, the developing unit 30F may form the dyeing-target toner images Z11 and Z13 with the dyeing-target toner.

The transfer section 40 may transfer the dyeing-target toner image Z11, the textile printing toner image Z12, and the dyeing-target toner image Z13 in this order onto the intermediate transfer belt 41, and thereafter transfer the dyeing-target toner image Z13, the textile printing toner image Z12, and the dyeing-target toner image Z11 in this order from the intermediate transfer belt 41 onto the print medium M.

The fixing section 50 may fix, after the dyeing-target toner image Z13, the textile printing toner image Z12, and the dyeing-target toner image Z11 are disposed in this order on the print medium M, the dyeing-target toner image Z13, the textile printing toner image Z12, and the dyeing-target toner image Z11 to the print medium M. This may allow the image G including the dyeing-target image G13, the textile printing image G12, and the dyeing-target image G11 to be formed on the surface of the print medium M.

The controller 71 may control a positional relationship between the dyeing-target toner images Z11 and Z13 formed by the developing unit 30F and the textile printing toner image Z12 formed by the developing units 30Y, 30M, 30C, and 30K.

For example, the controller 71 may dispose the dyeing-target toner image Z11, the textile printing toner image Z12, and the dyeing-target toner image Z13 in this order on the intermediate transfer belt 41. In this case, the dyeing-target toner image Z11 may be disposed on side closer to the intermediate transfer belt 41 and the dyeing-target toner image Z13 may be disposed on side farther from the intermediate transfer belt 41.

One reason why the controller 71 disposes the dyeing-target toner image Z11, the textile printing toner image Z12, and the dyeing-target toner image Z13 in this order on the intermediate transfer belt 41 is that the controller 71 may cause the dyeing-target toner image Z13, the textile printing toner image Z12, and the dyeing-target toner image Z11 to be disposed in this order on the print medium M eventually. In this case, the dyeing-target toner image Z13 may be disposed on side closer to the print medium M and the dyeing-target toner image Z11 may be disposed on side farther from the print medium M.

It is to be noted that a disposed amount (mg/cm$^2$) of the dyeing-target image G13 formed with the dyeing-target toner is not particularly limited. In one example, the disposed amount of the dyeing-target image G13 may be equal to or more than about 0.25 mg/cm$^2$. In another example, the disposed amount of the dyeing-target image G13 may be equal to or more than about 0.25 mg/cm$^2$ and equal to or less than about 0.68 mg/cm$^2$. One reason for this is that the foregoing range of the disposed amount of the dyeing-target image G13 may allow for sufficiently-high efficiency of transferring the image G from the print medium M onto the non-print medium L. The disposed amount of the dyeing-target image G13 is described as weight (mg) of the dyeing-target toner per unit area (cm$^2$).

[2-2. Operation]

In a case of forming the image G on the print medium M, the image forming apparatus may first repeatedly perform the developing process and the primary transfer process, and thereby form the dyeing-target toner image Z11, the textile printing toner image Z12, and the dyeing-target toner image Z13 in this order on the surface of the intermediate transfer belt 41, as illustrated in FIG. 8. As a result, the dyeing-target toner image Z11, the textile printing toner image Z12, and the dyeing-target toner image Z13 may be disposed in this order on the intermediate transfer belt 41.

Thereafter, the image forming apparatus may perform the secondary transfer process, and thereby allow the dyeing-target toner image Z13, the textile printing toner image Z12, and the dyeing-target toner image Z11 to be disposed in this order on the print medium M, as illustrated in FIG. 9.

Thereafter, the image forming apparatus may perform the fixing process, and thereby form the image G on the surface of the print medium M, as illustrated in FIG. 10. The image G may include the dyeing-target image G13 formed as a result of the fixing process performed on the dyeing-target toner image Z13, the textile printing image G12 formed as a result of the fixing process performed on the textile printing toner image Z12, and the dyeing-target image G11 formed as a result of the fixing process performed on the dyeing-target toner image Z11. In other words, the dyeing-target image G13, the textile printing image G12, and the dyeing-target image G11 may be disposed in this order on the print medium M.

[2-3. Example Workings and Example Effects]

In the image forming apparatus according to the second example embodiment, each of the developing units 30Y, 30M, 30C, and 30K may form the textile printing toner image Z12 by the textile printing toner, and the developing unit 30F may form the dyeing-target toner images Z11 and Z13 by the dyeing-target toner. The dyeing-target toner image Z13, the textile printing toner image Z12, and the dyeing-target toner image Z11 may be thereby disposed in this order on the print medium M.

In this case, the dyeing-target image G11 including the dyeing-target toner may be formed on the textile printing image G12 including the textile printing toner, as illustrated in FIG. 10. Accordingly, when the print medium M is heated while the print medium M is closely attached to the non-print medium L, the dyeing-target image G11 or the dyeing-target toner may be dyed with the textile printing dye included in the textile printing image G2 or the textile printing toner. Further, the dyeing-target image G11 dyed with the textile printing dye may be transferred onto the non-print medium L. As a result, the image I may be formed on the non-print medium L. Accordingly, as with the first example embodiment, the second example embodiment allows the efficiency of transferring the image G from the print medium M onto the non-print medium L to be higher than that in the comparative example illustrated in FIG. 7. Hence, the density of the image G transferred onto the non-print medium L is secured also according to the second example embodiment.

In addition, the dyeing-target image G13 including the dyeing-target toner may be formed under the textile printing image G12. Therefore, not only the dyeing-target image G11 but also the dyeing-target image G13 may be dyed with the textile printing dye. Moreover, when the print medium M is heated while being closely attached to the non-print medium L and thereafter is separated from the non-print medium L, part of the dyeing-target image G13 dyed with the textile printing dye may be transferred onto the non-print medium L together with part of the textile printing image G12. Therefore, the amount of the textile printing dye moved to the non-print medium L is increased. In this case, it is more difficult for part of the textile printing dye to pass through not only the non-print medium L but also the print medium M, owing to the presence of the dyeing-target images G11 and G13. This decreases the amount of loss of the textile printing dye. Accordingly, the efficiency of transferring the image G from the print medium M onto the non-print medium L is further increased. This further increases the density of the image G transferred onto the non-print medium L.

According to the description above, the efficiency of transferring the image G from the print medium M onto the non-print medium L is remarkably increased, and the density of the image G transferred onto the non-print medium L is also remarkably increased. It is therefore possible to form the image I with further higher quality on the non-print medium L. In other words, according to the second example embodiment, it is possible to form the image I higher in quality than according to the first example embodiment.

Example workings and example effects other than those described above regarding the image forming apparatus according to the second example embodiment may be similar to other example workings and other example effects regarding the image forming apparatus according to the first example embodiment.

3. APPLICATION EXAMPLES OF IMAGE

A description is given next of application examples of the image G formed by any of the image forming apparatuses described above.

The image G formed on the print medium M by any of the image forming apparatuses described above may be transferable from the print medium M onto the non-print medium L other than the print medium M by utilizing the properties of the textile printing dye that allow the textile printing dye to move to the non-print medium L when the textile printing dye is heated. Such properties of the textile printing dye may be so-called sublimation transfer properties. This allows for various applications of the image G depending on the type of the non-print medium L.

The type of the non-print medium L is not particularly limited. Non-limiting examples of the non-print medium L may include, however, paper, fabric, wood, metal, glass, ceramic, or resin. Non-limiting examples of the fabric may include clothes such as a T-shirt. Non-limiting examples of the ceramic may include dishes such as a mug. It is to be noted that, however, the fabric is not limited to clothes, and the ceramic is not limited to dishes. The resin is not limited to the polyester-based resin described above, and may be any resin other than the polyester-based resin.

[3-1. Method of Transferring Image Formed by Image Forming Apparatus According to First Example Embodiment]

A description is given first of a method of transferring, from the print medium M onto the non-print medium L, the image G formed by the image forming apparatus according to the first example embodiment.

As an example, a description is given below of a case where the image G formed on the print medium M is to be transferred onto the non-print medium L such as fabric, as described above. The method of transferring the image G described below may be iron-on transfer that uses an iron as a heating source, for example. The non-print medium L may be clothes such as a T-shirt in the example described below.

Figure 12:
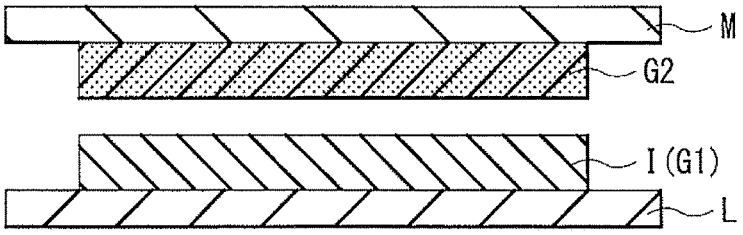
FIG. 12 is a cross-sectional view describing the method of transferring the image following that illustrated in FIG. 11.

FIGS. 11 and 12 each illustrate a cross-sectional configuration corresponding to that illustrated in FIG. 6 for describing the method of transferring the image G onto the non-print medium L.

In a case of transferring the image G onto the non-print medium L, as illustrated in FIG. 11, the print medium M on which the image G including the dyeing-target image G1 and the textile printing image G2 is formed may be first caused to face the non-print medium L onto which the image G is to be transferred. In this case, the print medium M may be so disposed that the dyeing-target image G1 faces the non-print medium L.

Thereafter, the print medium M may be closely attached to the non-print medium L. Thereafter, an iron may be pressed on the print medium M, and thereby thermal energy H may be supplied to the print medium M. FIG. 11 illustrates only the thermal energy H and omits illustration of the iron. It is to be noted that conditions regarding the iron may be set to any conditions. Non-limiting examples of the conditions regarding the iron may include temperature of the iron, a time period during which the iron is pressed on the print medium M, or weight applied to the print medium M by means of the iron.

As illustrated in FIG. 12, this may cause the textile printing dye to be moved from the textile printing image G2 or the textile printing toner to the dyeing-target image G1 or the dyeing-target toner by utilizing the thermal energy H. This may also cause the dyeing-target image G1 to be separated from the textile printing image G2. Accordingly, the dyeing-target image G1 may be dyed with the textile printing dye, and the dyeing-target image G1 dyed with the textile printing dye may be transferred onto the non-print medium L. As a result, the image I corresponding to the image G may be formed on the non-print medium L.

A description is given below of the quality of the image I formed on the non-print medium L.

Figure 13:
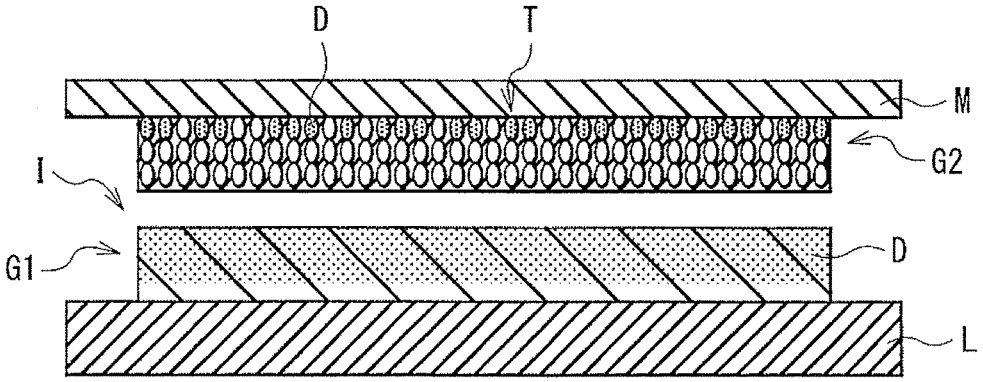
FIG. 13 is a cross-sectional view describing an example of a state of the image formed by the image forming apparatus according to one example embodiment of the technology and transferred onto the non-print medium.
Figure 14:
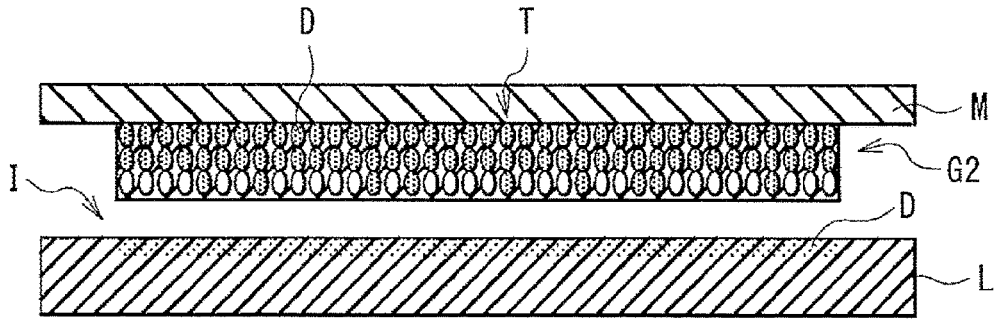
FIG. 14 RELATED ART
FIG. 14 is a cross-sectional view describing an example of a state of the image formed by the image forming apparatus according to the comparative example and transferred onto the non-print medium.

FIG. 13 illustrates a cross-sectional configuration of components including the non-print medium L for describing a state of transfer, onto the non-print medium L, of the image G formed by the image forming apparatus according to the first example embodiment illustrated in FIG. 6. FIG. 14 illustrates a cross-sectional configuration corresponding to that illustrated in FIG. 13 for describing a state of transfer, onto the non-print medium L, of the image G formed by the image forming apparatus according to the comparative embodiment illustrated in FIG. 7. It is to be noted that FIGS. 13 and 14 each illustrate a state in which the textile printing toner T in the textile printing image G2 includes the textile printing dye D.

In a case where the image G formed by the image forming apparatus according to the comparative example is transferred onto the non-print medium L, the textile printing dye D included in the textile printing image G2 or the textile printing toner T is directly moved to the non-print medium L, as illustrated in FIG. 14.

In this case, depending on the material of the non-print medium L, it is more difficult for the non-print medium L to be dyed with the textile printing dye D, as described above. This leads to a decrease in efficiency of transferring the image G from the print medium M onto the non-print medium L. In other words, an amount of the textile printing dye D moved from the textile printing image G2 to the non-print medium L is smaller relative to a total amount of the textile printing dye D that has been included in the textile printing image G2. This leads to, for example, insufficiency of the density of the image I formed on the non-print medium L. Hence, it is difficult to form the image I with high quality.

In contrast, in a case where the image G formed by the image forming apparatus according to the first example embodiment is transferred onto the non-print medium L, the dyeing-target image G1 or the dyeing-target toner may be dyed with the textile printing dye D included in the textile printing image G2 or the textile printing toner T, and the dyeing-target image G1 dyed with the textile printing dye D may be transferred onto the non-print medium L, as illustrated in FIG. 13. The textile printing dye D may be thus indirectly moved to the non-print medium L via the dyeing-target image G1.

In this case, a sufficient amount of the textile printing dye D may be moved from the textile printing image G2 to the dyeing-target image G1, owing to the properties, of the dyeing-target toner, that allow the dyeing-target toner to be easily dyed with the textile printing dye D, as described above. In addition, the dyeing-target image G1 sufficiently dyed with the textile printing dye D may be stably transferred onto the non-print medium L, independently of the material of the non-print medium L. This secures the amount of the textile printing dye D moved to the non-print medium L and dyeing properties, which increases the efficiency of transferring the image G from the print medium M onto the non-print medium L. In other words, the amount of the textile printing dye D moved from the textile printing image G2 to the non-print medium L may be sufficiently greater relative to the total amount of the textile printing dye D that has been included in the textile printing image G2. Accordingly, for example, the density of the image I formed on the non-print medium L is secured. Hence, it is possible to form the image I with higher quality.

[3-2. Method of Transferring Image Formed by Image Forming Apparatus According to Second Example Embodiment]

A description is given next of a method of transferring, from the print medium M onto the non-print medium L, the image G formed by the image forming apparatus according to the second example embodiment. Details of the method of transferring the image G formed by the image forming apparatus according to the second example embodiment may be, for example, similar to those of the method of transferring the image G formed by the image forming apparatus according to the first example embodiment, except for the following points.

Figure 15:
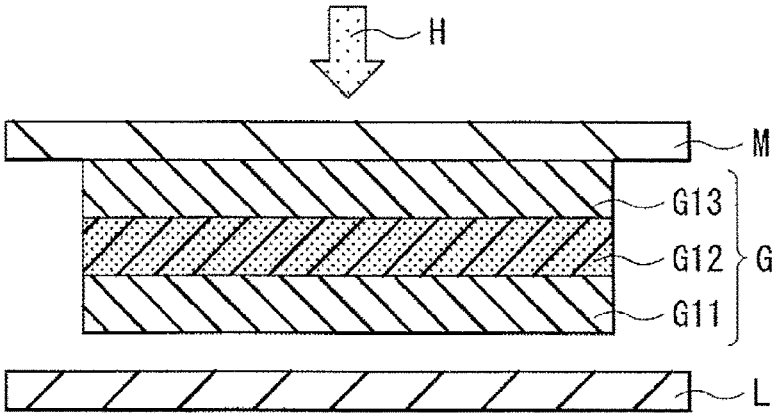
FIG. 15 is a cross-sectional view describing an example of a method of transferring, onto a non-print medium, the image formed by the image forming apparatus according to one example embodiment of the technology.
Figure 16:
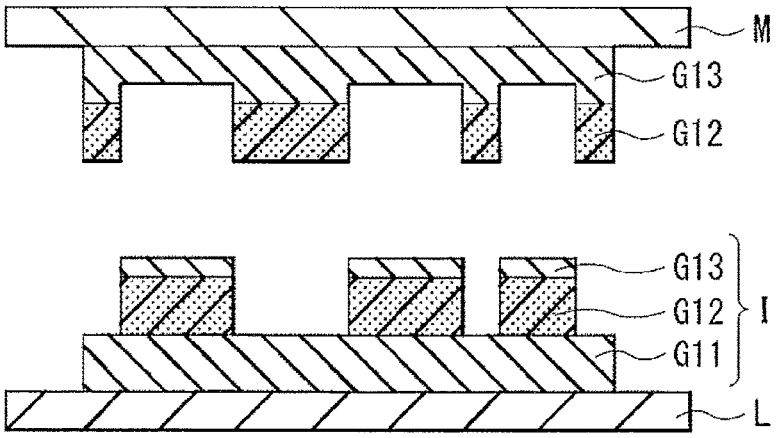
FIG. 16 is a cross-sectional view describing the method of transferring the image following that illustrated in FIG. 15.

FIGS. 15 and 16 each illustrate a cross-sectional configuration corresponding to that illustrated in FIG. 10 for describing the method of transferring the image G onto the non-print medium L.

In a case of transferring the image G onto the non-print medium L, as illustrated in FIG. 15, the print medium M on which the image G including the dyeing-target image G11, the textile printing image G12, and the dyeing-target image G13 is formed may be first caused to face the non-print medium L. In this case, the print medium M may be so disposed that the dyeing-target image G11 faces the non-print medium L.

Thereafter, the print medium M may be closely attached to the non-print medium L. Thereafter, an iron may be pressed on the print medium M, and thereby thermal energy H may be supplied to the print medium M. As illustrated in FIG. 16, this may cause the textile printing dye to be moved from the textile printing image G12 or the textile printing toner to the dyeing-target images G11 and G13 or the dyeing-target toner by utilizing the thermal energy H. This may also cause the dyeing-target image G11 to be separated from the textile printing image G12. Accordingly, the dyeing-target images G11 and G13 may be dyed with the textile printing dye, and the dyeing-target image G11 dyed with the textile printing dye may be transferred onto the non-print medium L. In this case, part of the textile printing image G12 and part of the dyeing-target image G13 dyed with the textile printing dye may be transferred onto the non-print medium L together with the dyeing-target image G11 dyed with the textile printing dye. As a result, the image I corresponding to the image G may be formed on the non-print medium L.

In a case where the image G formed by the image forming apparatus according to the second example embodiment is transferred onto the non-print medium L as illustrated in FIG. 16, part of the textile printing image G12 and part of the dyeing-target image G13 dyed with the textile printing dye may also be transferred onto the non-print medium L. Hence, compared with the case illustrated in FIG. 12 in which the image G formed by the image forming apparatus according to the first example embodiment is transferred onto the non-print medium L, the amount of the textile printing dye moved from the print medium M to the non-print medium L is increased. Therefore, the efficiency of transferring the image G from the print medium M onto the non-print medium L is also increased according to the second example embodiment.

4. MODIFICATION EXAMPLES

The configurations of the respective image forming apparatuses described above may be modified where appropriate.

Modification Example 1

For example, four types of textile printing toners, i.e., the yellow textile printing toner, the magenta textile printing toner, the cyan textile printing toner, and the black textile printing toner, may be used in the above-described example embodiments. The type of the textile printing toner is, however, changeable to any type. For example, three or less types of textile printing toners may be used. Alternatively, five or more types of textile printing toners may be used. Effects similar to those described above may be obtainable also in such cases by disposing the textile printing toner image Z2 and the dyeing-target toner image Z1 in this order on the print medium M.

Modification Example 2

The image forming apparatus of the intermediate transfer method that forms an image on the print medium M by means of the intermediate transfer belt 41 has been described above. However, for example, the technology is also applicable to an image forming apparatus of a direct transfer method that forms an image on the print medium M without the intermediate transfer belt 41, as illustrated in FIG. 17 corresponding to FIG. 1.

Figure 17:
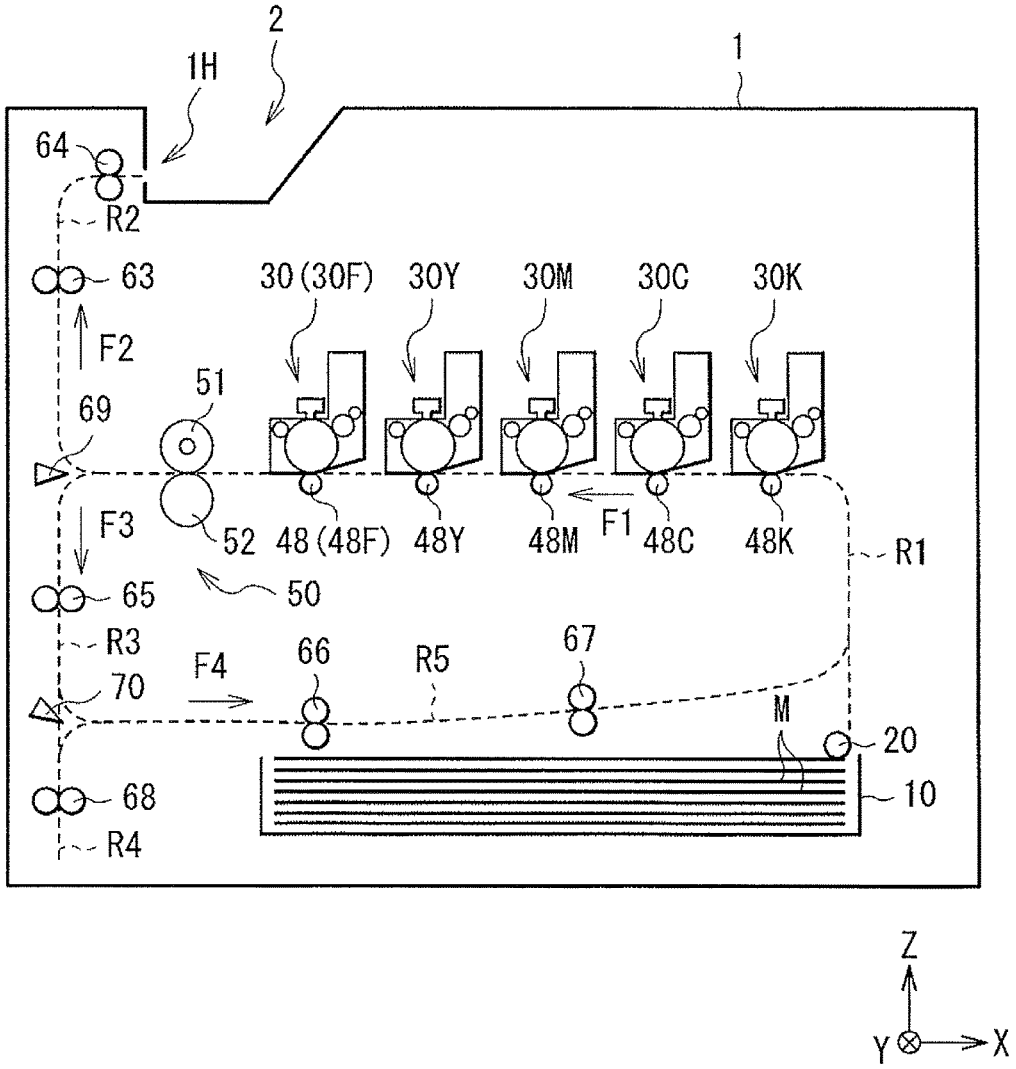
FIG. 17 is a plan view describing a modification example of the configuration of the image forming apparatus.

As illustrated in FIG. 17, the image forming apparatus of the direct transfer method may have a configuration similar to that of the image forming apparatus of the intermediate transfer method illustrated in FIGS. 1 to 3, except for the following points. Firstly, the image forming apparatus of the direct transfer method may include, in place of the transfer section 40, transfer rollers 48, i.e., transfer rollers 48F, 48Y, 48M, 48C, and 48K, corresponding to the primary transfer rollers 45, i.e., the primary transfer rollers 45F, 45Y, 45M, 45C, and 45K. Secondly, the developing units 30, i.e., the developing units 30F, 30Y, 30M, 30C, and 30K, and the transfer rollers 48, i.e., the transfer rollers 48F, 48Y, 48M, 48C, and 48K may be arranged along the conveyance route R1. Thirdly, the developing units 30F, 30Y, 30M, 30C, and 30K may be disposed in this order from downstream to upstream in the conveyance direction of the print medium M along the conveyance route R1, for example.

An operation of the image forming apparatus of the direct transfer method may be, for example, similar to that of the image forming apparatus of the intermediate transfer method, except that the image forming apparatus of the direct transfer method may perform a transfer process in place of the primary transfer process and the secondary transfer process. The operation in the transfer process may be similar to that in the primary transfer process. In other words, the transfer process may allow each of the dyeing-target toner and the textile printing toner both attached to the electrostatic latent image in the developing process to be transferred onto the surface of the print medium M.

The developing units 30, i.e., the developing units 30F, 30Y, 30M, 30C, and 30K, the transfer rollers 48, i.e., the transfer rollers 48F, 48Y, 48M, 48C, and 48K, and the controller 71 may correspond to the "image forming section" in one specific but non-limiting embodiment of the technology.

Also in the image forming apparatus of the direct transfer method, each of the developing units 30Y, 30M, 30C, and 30K may form the textile printing toner image Z2 by the textile printing toner, and the developing unit 30F may form the dyeing-target toner image Z1 by the dyeing-target toner. Thereby, the textile printing toner image Z2 and the dyeing-target toner image Z1 may be disposed in this order on the print medium M. Alternatively, each of the developing units 30Y, 30M, 30C, and 30K may form the textile printing toner image Z12 with the textile printing toner, and the developing unit 30F may form the dyeing-target toner images Z11 and Z13 with the dyeing-target toner. Thereby, the dyeing-target toner image Z13, the textile printing toner image Z12, and the dyeing-target toner image Z11 may be disposed in this order on the print medium M. Accordingly, it is possible for the image forming apparatus of the direct transfer method to form the image I with higher quality on the non-print medium L when the image G formed on the print medium M is transferred onto the non-print medium L such as fabric, for reasons similar to those described regarding the image forming apparatus of the intermediate transfer method.

Example workings and example effects other than those described above regarding the image forming apparatus of the direct transfer method may be similar to other example workings and other example effects regarding the image forming apparatus of the intermediate transfer method, except for the example workings and example effects owing to the transfer section 40 including the intermediate transfer belt 41.

Working Examples

A detailed description is given below of working examples of one example embodiment of the technology. The description is given in the following order.

1. Evaluation of Characteristics of Image Formed by Image Forming Apparatus According to First Example Embodiment
2. Evaluation of Characteristics of Image Formed by Image Forming Apparatus According to Second Example Embodiment

[1. Evaluation of Characteristics of Image Formed by Image Forming Apparatus According to First Example Embodiment]

First, characteristics of an image formed by the image forming apparatus according to the first example embodiment were evaluated.

Experiment Examples 1 to 16

The image G was formed, by the following procedures, on the print medium M by the image forming apparatus illustrated in FIGS. 1 to 3. Thereafter, characteristics of the image G were evaluated.

[Preparation of Image Forming Apparatus]

First, the image forming apparatus, the toner, and the print medium M were prepared.

A color printer MICROLINE VINCI C941dn available from Oki Data Corporation, Tokyo, Japan was used as the image forming apparatus. A printer paper of A4 size (Excellent white, size: 297 mm×210 mm) available from Oki Data Corporation, Tokyo, Japan was used as the print medium M.

[Type of Toner and Composition of Toner]

Five types of toners were used as the toner. Specifically, used were a colorless dyeing-target toner, i.e., a transparent dyeing-target toner, and four types of textile printing toners, i.e., the yellow textile printing toner, the magenta textile printing toner, the cyan textile printing toner, and the black textile printing toner.

The dyeing-target toner had the following composition.

Polymer compound: 100 parts by mass of amorphous polyester 5 parts by mass of crystalline polyester Release agent: 4 parts by mass of paraffin wax (SP-0145 available from NIPPON SEIRO Co., Ltd., Tokyo, Japan, melting point: 62° C.)

Electric charge control agent: 1 part by mass of BONTRON (registered trademark) P-51 (available from Orient Chemical Industries Co., Ltd., Osaka, Japan)

External additive: 1 part by mass of composite oxide particles (STX801 available from Nippon Aerosil Co., Ltd., Tokyo, Japan, average primary particle size: 18 nm) relative to 100 parts by mass of toner base particles

- 1 part by mass of colloidal silica (sol-gel silica X-24-9163A available from Shin-Etsu Chemical Co., Ltd., Tokyo, Japan, average particle size: 100 nm) relative to 100 parts by mass of the toner base particles
- 1 part by mass of silica powder (VPRY40S available from Nippon Aerosil Co., Ltd., Tokyo, Japan, average particle size: 80 nm) relative to 100 parts by mass of the toner base particles
- 1.5 parts by mass of silica powder (RY50 available from Nippon Aerosil Co., Ltd., Tokyo, Japan, average primary particle size: 40 nm) relative to 100 parts by mass of the toner base particles The yellow textile printing toner had the following composition.

Yellow textile printing dye: 5 parts by mass of C. L Reactive Yellow 2

Binder resin: 100 parts by mass of amorphous polyester

Electric charge control agent: 1 part by mass of BONTRON (registered trademark) P-51 (available from Orient Chemical Industries Co., Ltd., Osaka, Japan)

External additive: 3 parts by mass of hydrophobic silica fine powder (R972 available from Nippon Aerosil Co., Ltd., Tokyo, Japan, average particle size: 16 nm) relative to 100 parts by mass of the toner base particles The magenta textile printing toner had the following composition.

Magenta textile printing dye: 5 parts by mass of C. L Reactive Red 3

Binder resin: 100 parts by mass of amorphous polyester

Electric charge control agent: 1 part by mass of BONTRON (registered trademark) P-51 (available from Orient Chemical Industries Co., Ltd., Osaka, Japan)

External additive: 3 parts by mass of hydrophobic silica fine powder (R972 available from Nippon Aerosil Co., Ltd., Tokyo, Japan, average particle size: 16 nm) relative to 100 parts by mass of the toner base particles The cyan textile printing toner had the following composition.

Cyan textile printing dye: 5 parts by mass of C. L Disperse Blue 60

Binder resin: 100 parts by mass of amorphous polyester

Electric charge control agent: 1 part by mass of BONTRON (registered trademark) P-51 (available from Orient Chemical Industries Co., Ltd., Osaka, Japan)

External additive: 3 parts by mass of hydrophobic silica fine powder (R972 available from Nippon Aerosil Co., Ltd., Tokyo, Japan, average particle size: 16 nm) relative to 100 parts by mass of the toner base particles The black textile printing toner had the following composition.

Black textile printing dye: 5 parts by mass of C. L Reactive Black 5

Binder resin: 100 parts by mass of amorphous polyester

Electric charge control agent: 1 part by mass of BONTRON (registered trademark) P-51 (available from Orient Chemical Industries Co., Ltd., Osaka, Japan)

External additive: 3 parts by mass of hydrophobic silica fine powder (R972 available from Nippon Aerosil Co., Ltd., Tokyo, Japan, average particle size: 16 nm) relative to 100 parts by mass of the toner base particles

[Method of Manufacturing Toner]

A solution suspension method was used to fabricate the dyeing-target toner.

Specifically, first, a continuous phase was prepared. In this case, first, 11,024 parts by weight of a suspension stabilizer (industrial trisodium phosphate 12-water) was mixed with 329,676 parts by weight of an aqueous solvent (pure water). Thereafter, the mixture was stirred at 60° C. The suspension stabilizer was thereby dissolved, and a first aqueous solution was obtained as a result. Thereafter, diluted nitric acid directed to pH adjustment was added to the first aqueous solution. Further, 5,319 parts by weight of a suspension stabilizer (industrial calcium chloride anhydride) was mixed with 43,234 parts by weight of an aqueous solvent (pure water). Thereafter, the mixture was stirred. The suspension stabilizer was thereby dissolved, and a second aqueous solution was obtained as a result. Thereafter, the first aqueous solution and the second aqueous solution were mixed with each other. Thereafter, the mixture was stirred by a stirring apparatus (a line mill available from PRIMIX Corporation, Hyogo, Japan) at 3,566 rpm for 50 minutes at 60° C. The continuous phase was thereby obtained.

Thereafter, a disperse phase was prepared. In this case, first, an organic solvent (ethyl acetate, temperature: 50° C.) was prepared. Thereafter, 1,086 parts by weight of a release agent and 28 parts by weight of a fluorescent whitener were mixed in this order with 76,565 parts by weight of the organic solvent. Thereafter, the mixture was stirred. Thereafter, 13,361 parts by weight of a binder resin was mixed with the mixture, and a resultant mixture was stirred until a solid material was disappeared. The disperse phase was thereby obtained.

Thereafter, granulation was performed on the continuous phase and the disperse phase, and the toner base particles were thereby formed. In this case, the continuous phase and the disperse phase were mixed with each other, and the mixture was stirred by the foregoing stirring apparatus at 2,000 rpm for 50 minutes at 55° C. The mixture was suspended and granulated thereby. As a result, a slurry solution including the granulated material was obtained. Thereafter, the slurry solution was distillated under reduced pressure, and the organic solvent (ethyl acetate) included in the slurry solution was removed by volatilization. Thereafter, a pH adjuster (nitric acid) was added to the slurry solution, and the slurry solution was thereby adjusted to a pH of 1.5. Thereafter, the slurry solution was filtered, and the suspension stabilizer was thereby removed by dissolving. Thereafter, the granulated material included in the slurry solution was dehydrated, and the dehydrated granulated material was redispersed in an aqueous solution (pure water). Thereafter, the granulated material was cleansed by means of the aqueous solution (pure water). Thereafter, the granulated material was filtered. Thereafter, the filtered granulated material was dehydrated and dried. Thereafter, the granulated material dehydrated and dried was classified. The toner base particles were thereby obtained.

Thereafter, the toner base particles were subjected to an external additive process. As a result, the dyeing-target toner was manufactured. In this case, an external additive was mixed with the toner base particles, and the mixture was thereafter stirred by a stirring apparatus (a Henschel mixer available from NIPPON COKE & ENGINEERING Co., Ltd., Tokyo, Japan) at 5,400 rpm for 10 minutes. The dyeing-target toner was thereby obtained.

Pulverization was used to manufacture the textile printing toner. Specifically, first, the textile printing dye, i.e., corresponding one of the yellow textile printing dye, the magenta textile printing dye, the cyan textile printing dye, and the black textile printing dye, binder resin, and an electric charge control agent were mixed with each other, and a mixture was thereby obtained. Thereafter, the mixture was stirred by means of a Henschel mixer, and thereafter, the stirred mixture was subjected to melt kneading by means of a biaxial extruder. A kneaded material was thereby obtained. Thereafter, the kneaded material was cooled. Thereafter, the kneaded material was pulverized by means of a cutter mill having a screen with a diameter of 2 mm. Thereafter, the kneaded material was further pulverized by means of a collision-type pulverization apparatus (a dispersion separator available from Nippon Pneumatic Mfg. Co., Ltd., Osaka, Japan), and a pulverized material was thereby obtained. Thereafter, the pulverized material was classified by means of a wind force classifier, and the toner base particles were obtained thereby. Thereafter, the external additive was mixed with the toner base particles, and the mixture was stirred by means of a Henschel mixer for three minutes. The textile printing toner was thereby obtained.

[Physical Properties of Toner]

The thermal physical properties, i.e., endothermic properties, of the series of toners, i.e., the dyeing-target toner, the yellow textile printing toner, the magenta textile printing toner, the cyan textile printing toner, and the black textile printing toner, were examined by means of a differential scanning calorimeter (DSC), and results described in FIGS. 19 to 28 and Table 1 were obtained thereby. In this case, DSC6220 available from Hitachi High-Tech Science Corporation, Tokyo, Japan was used as the DSC.

Figure 19:
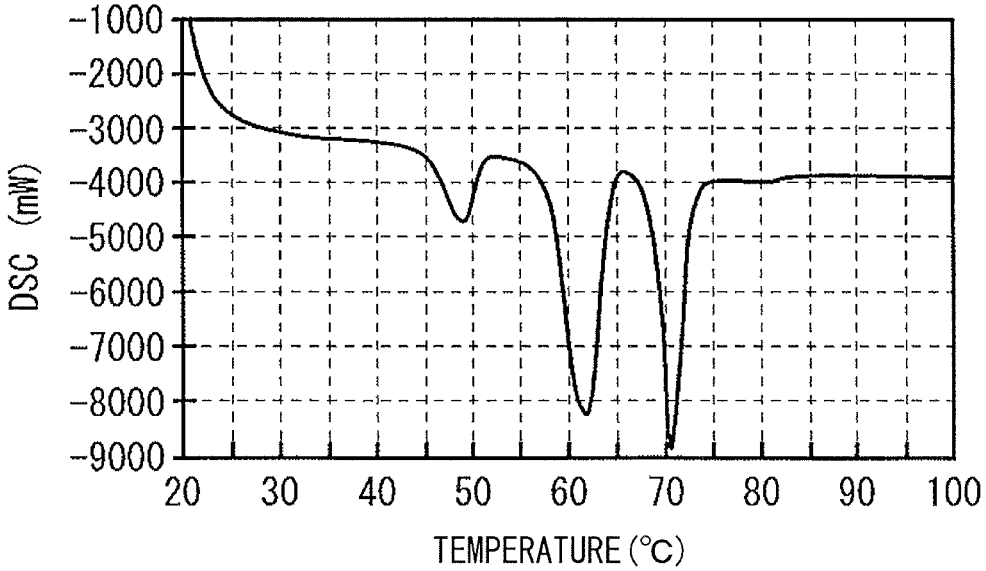
FIG. 19 is a graph illustrating an endothermic curve, regarding a dyeing-target toner, upon an increase in temperature for the first time.
Figure 20:
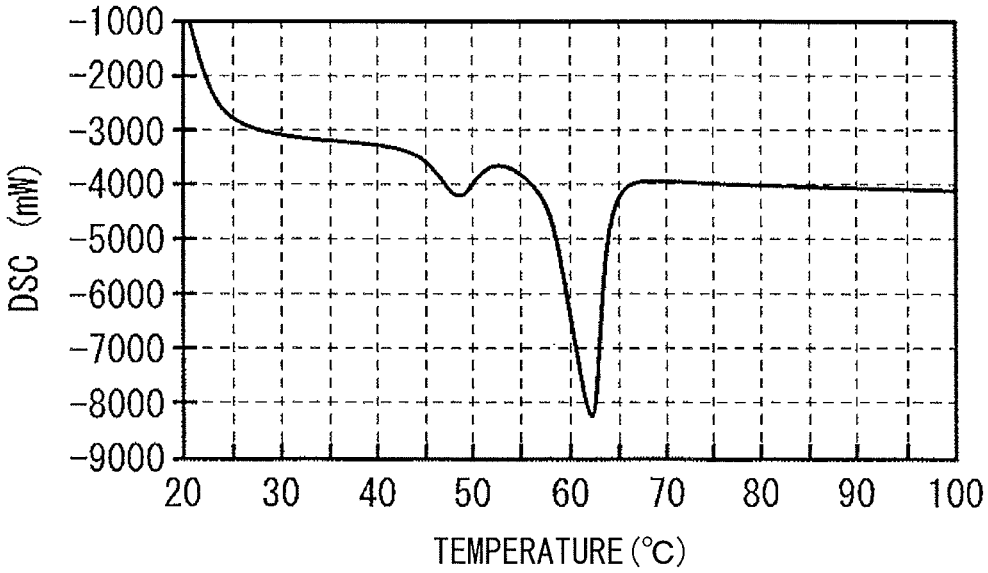
FIG. 20 is a graph illustrating an endothermic curve, regarding the dyeing-target toner, upon an increase in temperature for the second time.
Figure 21:
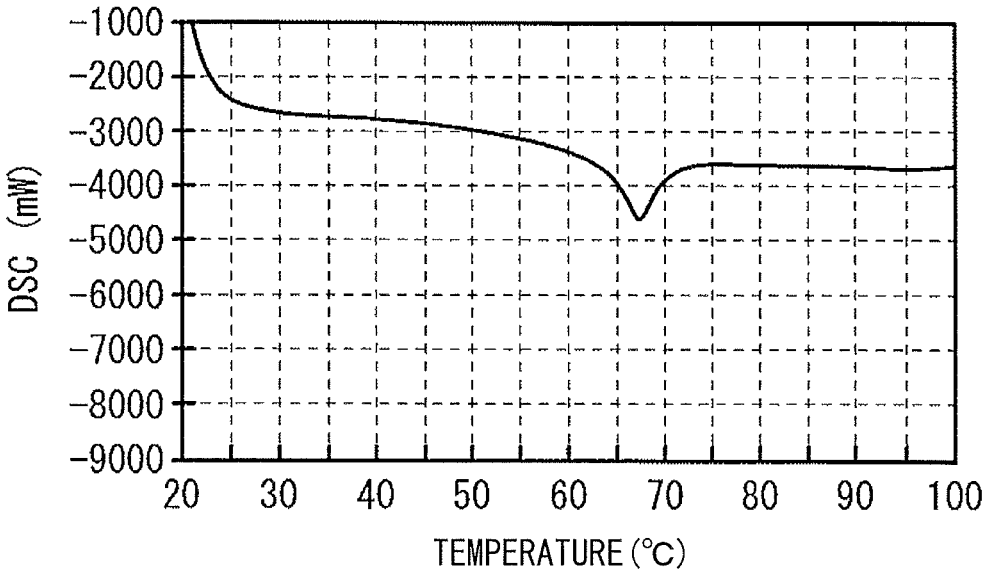
FIG. 21 is a graph illustrating an endothermic curve, regarding a yellow textile printing toner, upon an increase in temperature for the first time.
Figure 22:
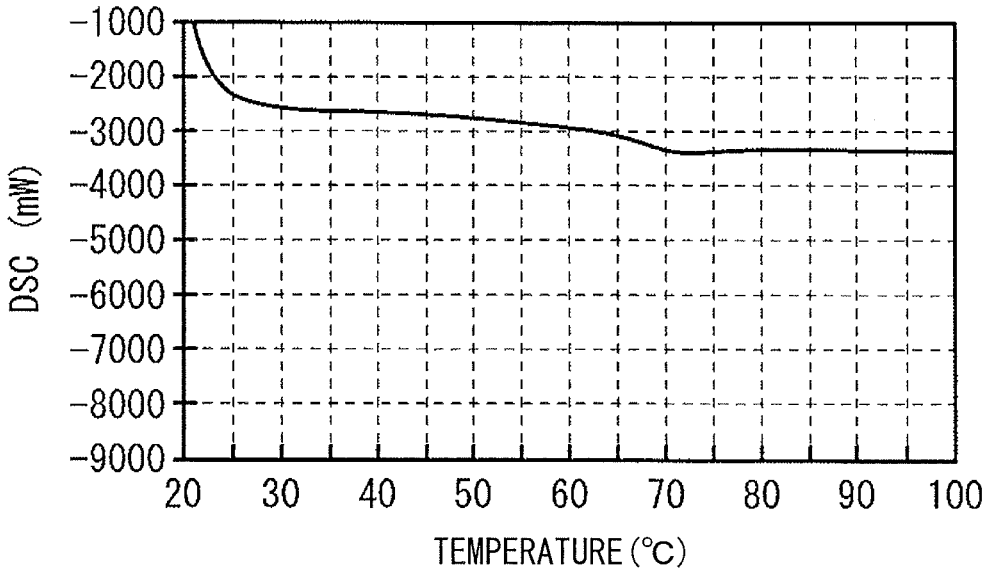
FIG. 22 is a graph illustrating an endothermic curve, regarding the yellow textile printing toner, upon an increase in temperature for the second time.
Figure 23:
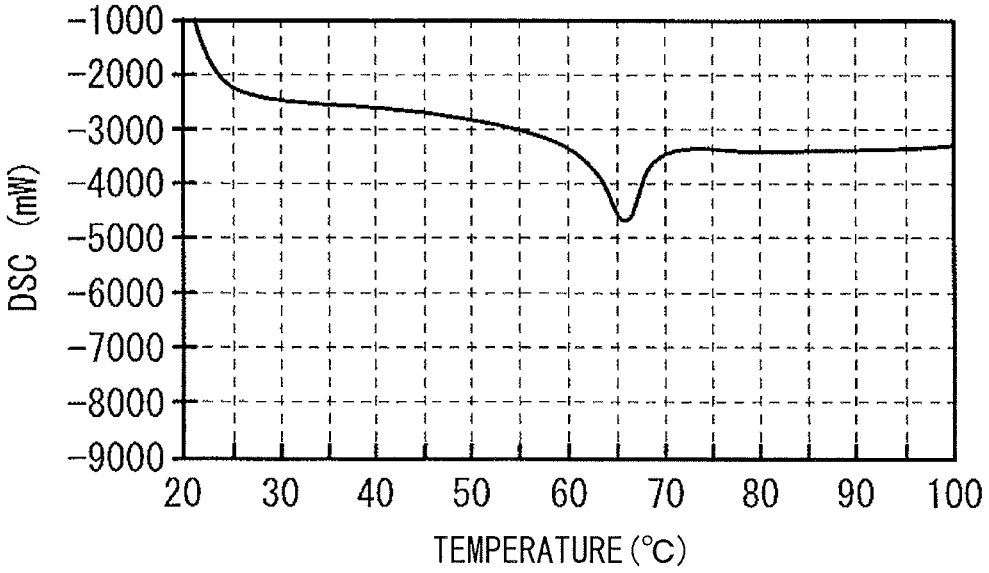
FIG. 23 is a graph illustrating an endothermic curve, regarding a magenta textile printing toner, upon an increase in temperature for the first time.
Figure 24:
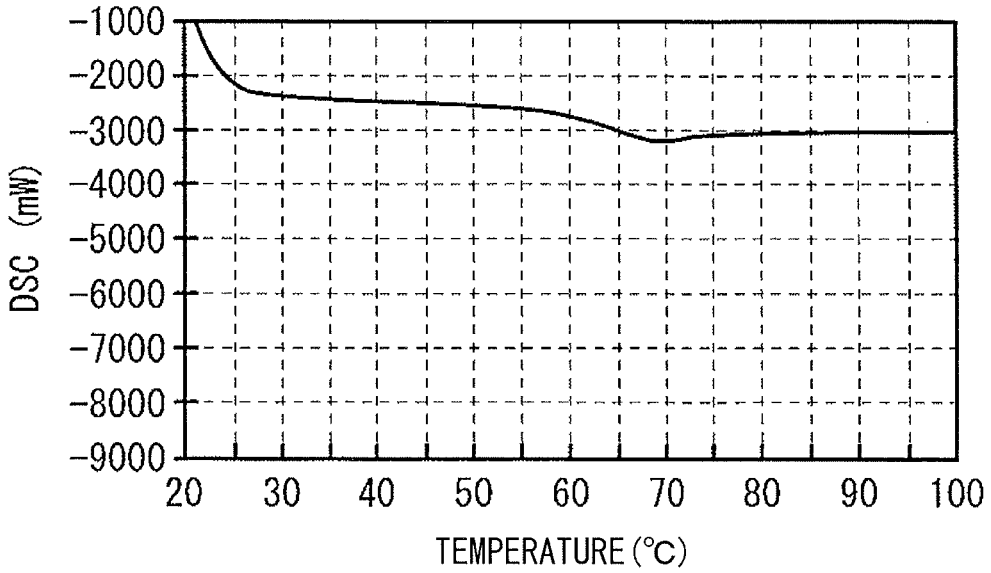
FIG. 24 is a graph illustrating an endothermic curve, regarding the magenta textile printing toner, upon an increase in temperature for the second time.
Figure 25:
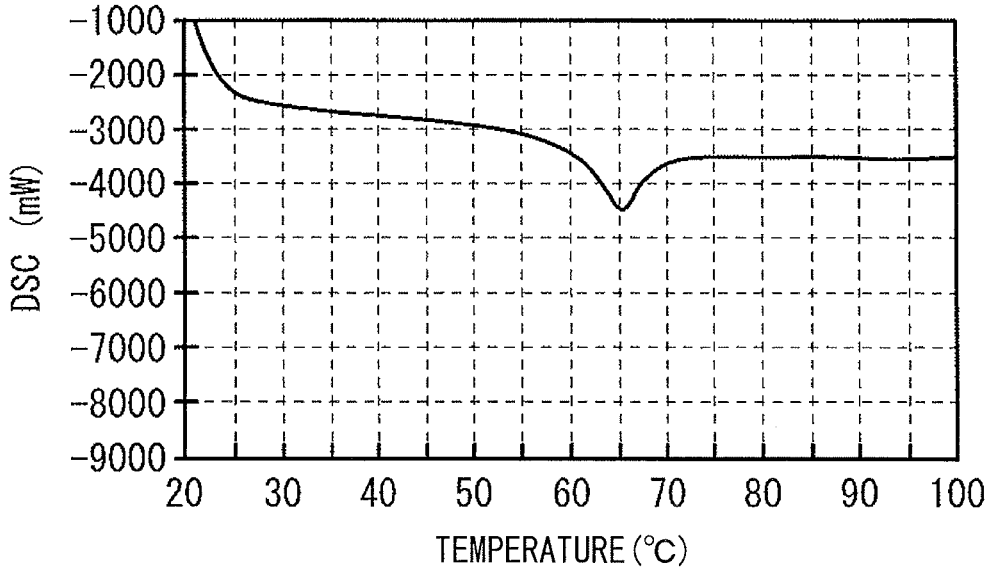
FIG. 25 is a graph illustrating an endothermic curve, regarding a cyan textile printing toner, upon an increase in temperature for the first time.
Figure 26:
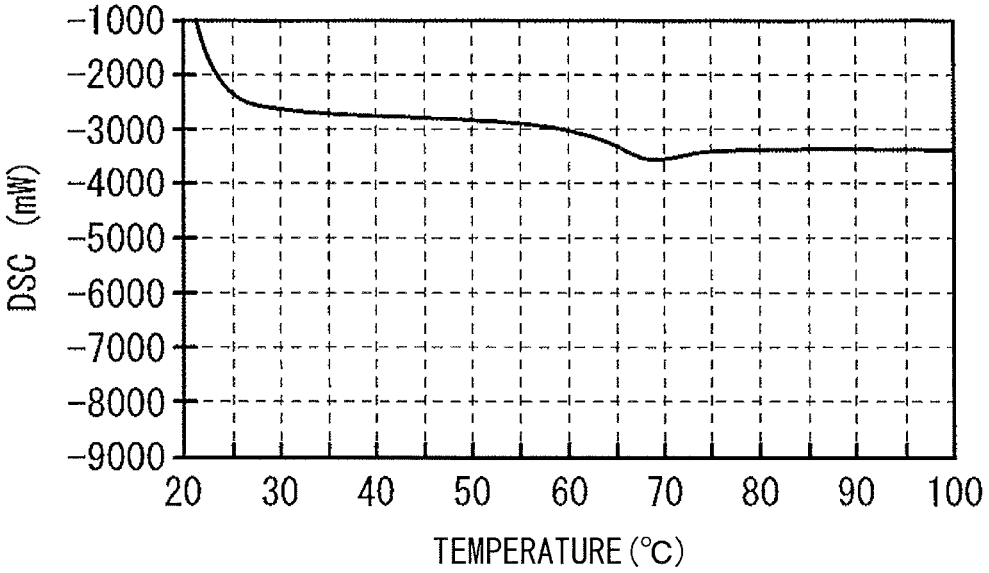
FIG. 26 is a graph illustrating an endothermic curve, regarding the cyan textile printing toner, upon an increase in temperature for the second time.
Figure 27:
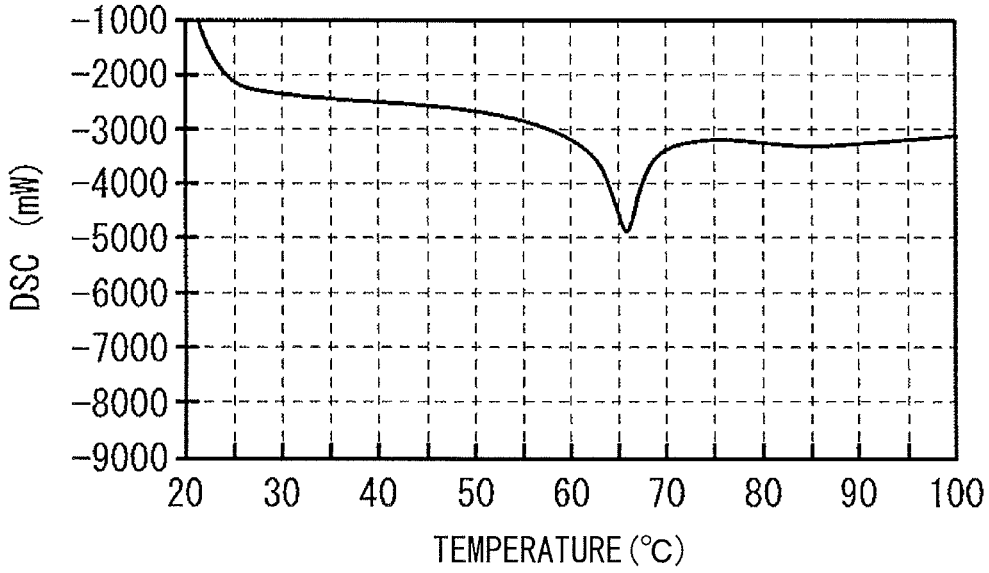
FIG. 27 is a graph illustrating an endothermic curve, regarding a black textile printing toner, upon an increase in temperature for the first time.
Figure 28:
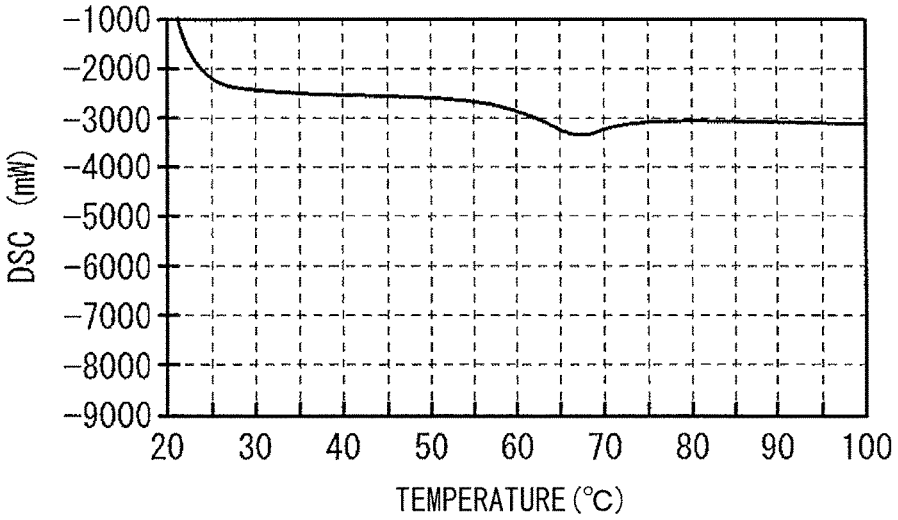
FIG. 28 is a graph illustrating an endothermic curve, regarding the black textile printing toner, upon an increase in temperature for the second time.

FIG. 19 illustrates an endothermic curve, regarding the dyeing-target toner, upon an increase in temperature for the first time. FIG. 20 illustrates an endothermic curve, regarding the dyeing-target toner, upon an increase in temperature for the second time. FIG. 21 illustrates an endothermic curve, regarding the yellow textile printing toner, upon an increase in temperature for the first time. FIG. 22 illustrates an endothermic curve, regarding the yellow textile printing toner, upon an increase in temperature for the second time. FIG. 23 illustrates an endothermic curve, regarding the magenta textile printing toner, upon an increase in temperature for the first time. FIG. 24 illustrates an endothermic curve, regarding the magenta textile printing toner, upon an increase in temperature for the second time. FIG. 25 illustrates an endothermic curve, regarding the cyan textile printing toner, upon an increase in temperature for the first time. FIG. 26 illustrates an endothermic curve, regarding the cyan textile printing toner, upon an increase in temperature for the second time. FIG. 27 illustrates an endothermic curve, regarding the black textile printing toner, upon an increase in temperature for the first time. FIG. 28 illustrates an endothermic curve, regarding the black textile printing toner, upon an increase in temperature for the second time. In each of FIGS. 19 to 28, a horizontal axis indicates temperature (° C.), and a vertical axis indicates the DSC, i.e., an endothermic amount (mW).

Conditions for measuring the endothermic curve, i.e., temperature program patterns of the DSC, were as follows. Upon the increase in temperature for the first time, each toner was left at 20° C. for 10 minutes, the toner was heated up to 200° C. at a temperature increase speed of 10° C./min. The toner was left at 200° C. for 5 minutes, and thereafter, cooled down to 0° C. at a temperature decrease speed of 90° C./min. The toner was left at 0° C. for five minutes. Upon the increase in temperature for the second time, each toner was heated up to 20° C. at a temperature increase speed of 60° C./min. The toner was left at 20° C. for 10 minutes, and thereafter, heated up to 200° C. at a temperature increase speed of 10° C./min.

Table 1 describes, as the thermal physical properties of each toner, glass transition temperature Tg 1st (° C.) of each toner upon the increase in temperature for the first time, glass transition temperature Tg 2nd (° C.) of each toner upon the increase in temperature for the second time, an endothermic amount (mJ/mg) of the release agent (wax), and peak-top temperature (° C.) of the release agent. The peak-top temperature is top temperature of the peak detected upon the increase in temperature for the second time.

TABLE 1

| Toner | Tg 1st (° C.) | Tg 2nd (° C.) | Endothermic amount (mJ/mg) | Peak-top temperature (° C.) |
|---|---|---|---|---|
| Dyeing-target toner | 68.3 | 56.2 | 10.7 | 62.0 |
| Yellow textile printing toner | 61.8 | 63.2 | 0.41 | 72.6 |
| Magenta textile printing toner | 60.4 | 59.5 | 0.78 | 69.3 |
| Cyan textile printing toner | 59.5 | 60.2 | 1.17 | 68.9 |
| Black textile printing toner | 60.0 | 59.5 | 1.51 | 67.5 |

As described in FIGS. 19 to 28 and Table 1, the dyeing-target toner and the textile printing toner, i.e., the yellow textile printing toner, the magenta textile printing toner, the cyan textile printing toner, and the black textile printing toner, had a great difference in endothermic physical properties depending on whether the release agent was included.

Specifically, a greater endothermic amount was obtained in the case of the dyeing-target toner including the release agent. In contrast, the endothermic amount was remarkably smaller in the case of the textile printing toner including no release agent, compared with that in the case of the dyeing-target toner including the release agent described above.

[Formation of Image]

Next, the image G was formed on the print medium M by means of the image forming apparatus described above.

As environmental conditions, temperature was set to 25° C. and humidity was set to 55%. As conditions for forming the image G, a speed of forming the image G, i.e., a linear speed of an outermost peripheral of the photosensitive drum was set to 58.7 mm/sec, a traveling direction of the print medium M was set to a longitudinal direction, a voltage applied to the electric charging roller 33 was set to +970 V, a voltage applied to the developing roller 34 was set to −175 V, and a voltage applied to the feeding roller 35 was set to −285 V.

In a case of forming the image G, the textile printing image G2 and the dyeing-target image G1 were formed in this order on the print medium M. In this case, the dyeing-target image G1 was formed with the dyeing-target toner, and the textile printing image G2 of each color was formed with corresponding one of the four types of textile printing toners, i.e., the yellow textile printing toner, the magenta textile printing toner, the cyan textile printing toner, and the black textile printing toner. Further, an image pattern of each of the textile printing image G2 and the dyeing-target image G1 was set to a solid image, and a printing rate was set to 100%. It is to be noted that the density of the image G was so adjusted that the density of the image G measured by means of a density measuring device (a spectroscopic densitometer available from X-Rite, Inc., Michigan, U.S.A) fell within a range from 1.45 to 1.55.

For comparison, another image G was formed on the print medium M by procedures similar to those described above except that the dyeing-target image G1 was not formed and only the textile printing image G2 was formed.

Table 2 describes the color (Y, M, C, or K) of the textile printing image G2, a disposed amount of the textile printing image G2 (mg/cm$^2$), presence or absence of the dyeing-target image G1, and a disposed amount of the dyeing-target image G1 (mg/cm$^2$). In Table 2, "Y", "M", "C", and "K" represent yellow, magenta, cyan, and black, respectively. The disposed amount of the textile printing image G2 is described as the weight of the textile printing toner per unit area. The disposed amount of the dyeing-target image G1 is described as the weight of the dyeing-target toner per unit area. In this case, the disposed amount of each of the textile printing image G2 and the dyeing-target image G1 was varied by varying the voltage applied to the developing roller 34.

[Evaluation of Characteristics of Image]

Next, a so-called iron-on transfer was performed by the procedures described above, and the characteristics of the image G formed on the print medium M were evaluated thereby. In this case, transfer efficiency (%) was determined as an index on the basis of which the characteristics of the image G were evaluated by the following procedures, and results described in Table 2 were obtained.

Specifically, first, the image G was formed on the print medium M, and the density of the formed image G was measured.

Figure 18:
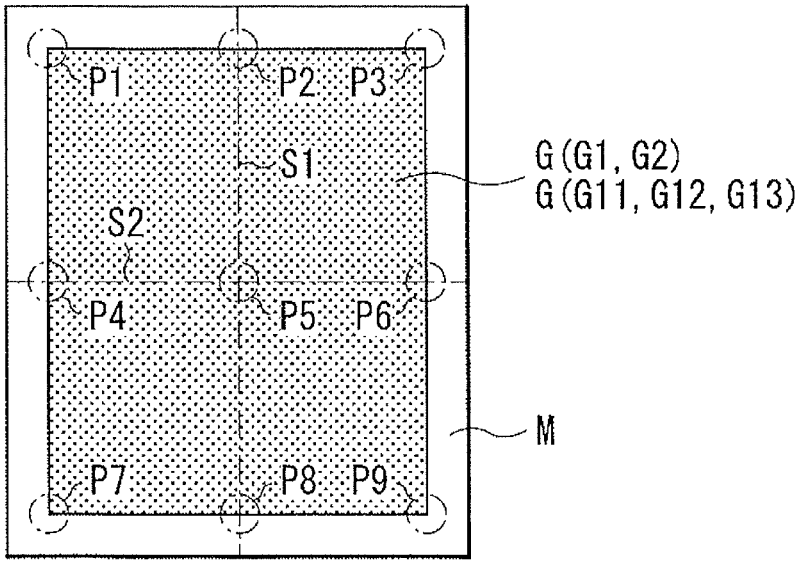
FIG. 18 is a plan view describing a position at which density of the image is measured.

FIG. 18 illustrates a planar configuration of the print medium M on which the image G was formed, and describes positions at which the density of the image G was measured. Each of the dyeing-target image G1 and the textile printing image G2 was formed in the middle region of the surface of the print medium M, as illustrated in FIG. 18. It is to be noted that a hatched region in FIG. 18 indicates a range in which the image G including the dyeing-target image G1 and the textile printing image G2 was formed.

In FIG. 18, a virtual line S1 bisects the surface of the print medium M in a short-side direction, and a virtual line S2 bisects the surface of the print medium M in a longitudinal direction. Further, positions P1 to P9 indicate respective positions at which the density was measured. The positions P1, P3, P7, and P9 are located at respective four corners of the image G The positions P2 and P8 are located at respective intersection points of the virtual line S1 and two edges of the image G in the longitudinal direction. The positions P4 and P6 are located at respective intersection points of the virtual line S2 and two edges of the image G in the short-side direction. The position P5 is located at an intersection point of the virtual line S1 and the virtual line S2.

In a case of measuring the density of the image G, the density was measured at nine positions, i.e., the positions P1 to P9, and an average value of the nine measured values of the density was calculated. As the density measuring device, a spectroscopic densitometer X-Rite 528 available from X-Rite, Inc., Michigan, U.S.A was used.

Thereafter, iron-on transfer, i.e., T-shirt printing, was performed using the print medium M on which the image G is formed. In this case, the print medium M was closely attached to the non-print medium L, and thereafter, a heating source was pressed on the print medium M, as described above referring to FIGS. 11 and 12.

As the non-print medium L, fabric for T-shirt printing (ComfortSoft, made of cotton 100%) available from Hanesbrands Inc., North Carolina, U.S.A was used. One reason why the fabric made of cotton 100% was used is to make apparent difference in characteristics of the image G between the case with the dyeing-target image G1 and the case without the dyeing-target image G1. As the heating source, a heating press machine Model HTP234PS1 available from TheMagicTouch GmbH, Dieburg, Germany was used. Temperature of the heating source was set to 200° C., and a time period during which the heating source was pressed on the non-print medium L was set to 60 seconds.

The non-print medium L was thereby dyed with the textile printing dye included in the textile printing image G2, i.e., the textile printing toner. As a result, the image I corresponding to the image G was formed on the non-print medium L, as illustrated in FIG. 12.

Thereafter, the density of the image I was measured also by means of the density measuring device described above. In this case, the density was measured at nine positions corresponding to the positions P1 to P9 illustrated in FIG. 18, and an average value of the nine measured values of the density was calculated.

Thereafter, transfer efficiency (%) was calculated on the basis of results of the measurement of the density of the image I described above. The transfer efficiency was calculated by the expression: (transfer efficiency)=(density of image I/density of image G)×100.

TABLE 2

| | Textile printing image | | Dyeing-target image | | |
|---|---|---|---|---|---|
| Experiment example | Color | Disposed amount of image (mg/cm$^2$) | Color | Disposed amount of image (mg/cm$^2$) | Transfer efficiency (%) |
| 1 | Y | 0.40 | — | — | 40.4 |
| 2 | Y | 0.40 | Transparent | 0.29 | 48.1 |
| 3 | Y | 0.40 | Transparent | 0.49 | 48.9 |
| 4 | Y | 0.40 | Transparent | 0.68 | 51.5 |
| 5 | M | 0.41 | — | — | 31.3 |
| 6 | M | 0.41 | Transparent | 0.29 | 38.8 |
| 7 | M | 0.41 | Transparent | 0.49 | 40.4 |
| 8 | M | 0.41 | Transparent | 0.68 | 48.2 |
| 9 | C | 0.51 | — | — | 31.4 |
| 10 | C | 0.51 | Transparent | 0.29 | 40.6 |
| 11 | C | 0.51 | Transparent | 0.49 | 43.8 |
| 12 | C | 0.51 | Transparent | 0.68 | 46.9 |
| 13 | K | 0.30 | — | — | 43.4 |
| 14 | K | 0.30 | Transparent | 0.29 | 48.1 |
| 15 | K | 0.30 | Transparent | 0.49 | 49.2 |
| 16 | K | 0.30 | Transparent | 0.68 | 55.2 |

[Results]

As described in Table 2, the transfer efficiency was varied greatly depending on presence or absence of the dyeing-target image G1. Specifically, in a case where the dyeing-target image G1 was formed together with the textile printing image G2 (Experiment examples 2 to 4, 6 to 8, 10 to 12, and 14 to 16), the transfer efficiency was higher than that in a case where the dyeing-target image G1 was not formed (Experiment examples 1, 5, 9, and 13), independently of the color of the textile printing image G2.

In particular, among the cases where the dyeing-target image G1 was formed, the transfer efficiency was higher as the disposed amount of the dyeing-target image G1 was greater.

According to the results described above, the efficiency of transferring the image G onto the non-print medium L such as fabric was improved when the image G formed on the print medium M was transferred onto the non-print medium L, by disposing, on the print medium M, the textile printing toner image Z2 formed with the textile printing toner including the textile printing dye and the dyeing-target toner image Z1 formed with the dyeing-target toner including the polymer compound to be dyed with the textile printing toner. Accordingly, the image I with higher quality was formed on the non-print medium L.

[2. Evaluation of Characteristics of Image Formed by Image Forming Apparatus According to Second Example Embodiment]

Next, characteristics of an image formed by the image forming apparatus according to the second example embodiment were evaluated.

Experiment Examples 17 to 76

The image G including the dyeing-target image G13, the textile printing image G12, and the dyeing-target image G11 was formed on the print medium M by the image forming apparatus according to the second example embodiment, and thereafter, characteristics of the image G were evaluated, as described in Tables 3 to 5. Details of procedures of image formation and details of procedures of image evaluation were similar to those described in the case where the characteristics of the image formed by the image forming apparatus according to the first example embodiment were evaluated, except for the following points.

[Formation of Image and Evaluation of Characteristics of Image]

In a case of forming the image G, the dyeing-target image G13, the textile printing image G12, and the dyeing-target image G11 were formed in this order on the print medium M. In this case, the dyeing-target images G11 and G13 were formed with the dyeing-target toner, and the textile printing image G12 of each color was formed with corresponding one of the four types of textile printing toners, i.e., the yellow textile printing toner, the magenta textile printing toner, the cyan textile printing toner, and the black textile printing toner. Further, an image pattern of each of the textile printing image G12 and the dyeing-target images G11 and G1 was set to a solid image, and a printing rate was set to 100%.

For comparison, another image G including the textile printing image G2 and the dyeing-target image G1 was formed by the image forming apparatus according to the first example embodiment. Further, for comparison, another image G was formed on the print medium M by procedures similar to those described above except that the dyeing-target images G11 and G13 were not formed and only the textile printing image G12 was formed.

Tables 3 to 5 describe the color (Y, M, C, or K) of the textile printing image G12, a disposed amount of the textile printing image G12 (mg/cm$^2$), presence or absence of each of the dyeing-target images G11 and G13, and a disposed amount of each of the dyeing-target images G11 and G13 (mg/cm$^2$). The disposed amount of the textile printing image G12 is described as the weight of the textile printing toner per unit area. The disposed amount of each of the dyeing-target images G11 and G13 is described as the weight of the dyeing-target toner per unit area. In this case, the disposed amount of each of the textile printing image G12, and the dyeing-target images G11 and G13 was varied by varying the voltage applied to the developing roller 34.

In order to evaluate the characteristics of the image G formed on the print medium M, the image I was formed on the non-print medium L by performing the iron-on transfer, and thereafter, the transfer efficiency (%) was determined. Results of the evaluation are as described in Tables 3 to 5. In this case, a time period during which the heating source was pressed on the non-print medium L was set to 120 seconds. It is to be noted that, in Tables 3 to 5, "dyeing-target image (lower layer)" represents the dyeing-target image G13, and "dyeing-target image (upper layer)" represents the dyeing-target image G11.

TABLE 3

| | Dyeing-target image (Lower layer) | | Textile printing image | | Dyeing-target image (Upper layer) | | |
|---|---|---|---|---|---|---|---|
| Experiment example | Color | Disposed amount of image (mg/cm$^2$) | Color | Disposed amount of image (mg/cm$^2$) | Color | Disposed amount of image (mg/cm$^2$) | Transfer efficiency (%) |
| 17 | — | — | Y | 0.40 | — | — | 46.8 |
| 18 | — | — | Y | 0.40 | Transparent | 0.25 | 61.0 |
| 19 | Transparent | 0.25 | Y | 0.40 | Transparent | 0.25 | 66.0 |
| 20 | Transparent | 0.47 | Y | 0.40 | Transparent | 0.25 | 71.6 |
| 21 | Transparent | 0.68 | Y | 0.40 | Transparent | 0.25 | 70.9 |
| 22 | — | — | M | 0.41 | — | — | 41.8 |
| 23 | — | — | M | 0.41 | Transparent | 0.25 | 54.8 |
| 24 | Transparent | 0.25 | M | 0.41 | Transparent | 0.25 | 58.9 |
| 25 | Transparent | 0.47 | M | 0.41 | Transparent | 0.25 | 63.7 |
| 26 | Transparent | 0.68 | M | 0.41 | Transparent | 0.25 | 64.4 |
| 27 | — | — | C | 0.51 | — | — | 41.8 |
| 28 | — | — | C | 0.51 | Transparent | 0.25 | 50.0 |
| 29 | Transparent | 0.25 | C | 0.51 | Transparent | 0.25 | 60.3 |
| 30 | Transparent | 0.47 | C | 0.51 | Transparent | 0.25 | 61.6 |
| 31 | Transparent | 0.68 | C | 0.51 | Transparent | 0.25 | 62.3 |
| 32 | — | — | K | 0.30 | — | — | 44.1 |
| 33 | — | — | K | 0.30 | Transparent | 0.25 | 55.9 |
| 34 | Transparent | 0.25 | K | 0.30 | Transparent | 0.25 | 66.9 |
| 35 | Transparent | 0.47 | K | 0.30 | Transparent | 0.25 | 71.7 |
| 36 | Transparent | 0.68 | K | 0.30 | Transparent | 0.25 | 70.3 |

TABLE 4

| | Dyeing-target image (Lower layer) | | Textile printing image | | Dyeing-target image (Upper layer) | | |
|---|---|---|---|---|---|---|---|
| Experiment example | Color | Disposed amount of image (mg/cm$^2$) | Color | Disposed amount of image (mg/cm$^2$) | Color | Disposed amount of image (mg/cm$^2$) | Transfer efficiency (%) |
| 37 | — | — | Y | 0.40 | — | — | 46.8 |
| 38 | — | — | Y | 0.40 | Transparent | 0.47 | 68.1 |
| 39 | Transparent | 0.25 | Y | 0.40 | Transparent | 0.47 | 70.2 |

TABLE 4-continued

| Experiment example | Dyeing-target image (Lower layer) Color | Disposed amount of image (mg/cm$^2$) | Textile printing image Color | Disposed amount of image (mg/cm$^2$) | Dyeing-target image (Upper layer) Color | Disposed amount of image (mg/cm$^2$) | Transfer efficiency (%) |
|---|---|---|---|---|---|---|---|
| 40 | Transparent | 0.47 | Y | 0.40 | Transparent | 0.47 | 77.3 |
| 41 | Transparent | 0.68 | Y | 0.40 | Transparent | 0.47 | 77.3 |
| 42 | — | — | M | 0.41 | — | — | 41.8 |
| 43 | — | — | M | 0.41 | Transparent | 0.47 | 61.0 |
| 44 | Transparent | 0.25 | M | 0.41 | Transparent | 0.47 | 63.7 |
| 45 | Transparent | 0.47 | M | 0.41 | Transparent | 0.47 | 69.2 |
| 46 | Transparent | 0.68 | M | 0.41 | Transparent | 0.47 | 70.5 |
| 47 | — | — | C | 0.51 | — | — | 41.8 |
| 48 | — | — | C | 0.51 | Transparent | 0.47 | 58.2 |
| 49 | Transparent | 0.25 | C | 0.51 | Transparent | 0.47 | 63.0 |
| 50 | Transparent | 0.47 | C | 0.51 | Transparent | 0.47 | 68.5 |
| 51 | Transparent | 0.68 | C | 0.51 | Transparent | 0.47 | 68.5 |
| 52 | — | — | K | 0.30 | — | — | 44.1 |
| 53 | — | — | K | 0.30 | Transparent | 0.47 | 60.7 |
| 54 | Transparent | 0.25 | K | 0.30 | Transparent | 0.47 | 68.3 |
| 55 | Transparent | 0.47 | K | 0.30 | Transparent | 0.47 | 74.5 |
| 56 | Transparent | 0.68 | K | 0.30 | Transparent | 0.47 | 74.5 |

TABLE 5

| Experiment example | Dyeing-target image (Lower layer) Color | Disposed amount of image (mg/cm$^2$) | Textile printing image Color | Disposed amount of image (mg/cm$^2$) | Dyeing-target image (Upper layer) Color | Disposed amount of image (mg/cm$^2$) | Transfer efficiency (%) |
|---|---|---|---|---|---|---|---|
| 57 | — | — | Y | 0.40 | — | — | 46.8 |
| 58 | — | — | Y | 0.40 | Transparent | 0.68 | 69.5 |
| 59 | Transparent | 0.25 | Y | 0.40 | Transparent | 0.68 | 72.3 |
| 60 | Transparent | 0.47 | Y | 0.40 | Transparent | 0.68 | 85.8 |
| 61 | Transparent | 0.68 | Y | 0.40 | Transparent | 0.68 | 87.2 |
| 62 | — | — | M | 0.41 | — | — | 41.8 |
| 63 | — | — | M | 0.41 | Transparent | 0.68 | 63.7 |
| 64 | Transparent | 0.25 | M | 0.41 | Transparent | 0.68 | 69.9 |
| 65 | Transparent | 0.47 | M | 0.41 | Transparent | 0.68 | 78.8 |
| 66 | Transparent | 0.68 | M | 0.41 | Transparent | 0.68 | 78.1 |
| 67 | — | — | C | 0.51 | — | — | 41.8 |
| 68 | — | — | C | 0.51 | Transparent | 0.68 | 63.7 |
| 69 | Transparent | 0.25 | C | 0.51 | Transparent | 0.68 | 66.4 |
| 70 | Transparent | 0.47 | C | 0.51 | Transparent | 0.68 | 76.0 |
| 71 | Transparent | 0.68 | C | 0.51 | Transparent | 0.68 | 77.4 |
| 72 | — | — | K | 0.30 | — | — | 44.1 |
| 73 | — | — | K | 0.30 | Transparent | 0.68 | 64.1 |
| 74 | Transparent | 0.25 | K | 0.30 | Transparent | 0.68 | 70.3 |
| 75 | Transparent | 0.47 | K | 0.30 | Transparent | 0.68 | 83.4 |
| 76 | Transparent | 0.68 | K | 0.30 | Transparent | 0.68 | 82.8 |

[Results]

As described in Tables 3 to 5, the transfer efficiency was varied greatly depending on presence or absence of the dyeing-target images G11 and G13.

Specifically, in a case where the dyeing-target image G1 was formed together with the textile printing image G2 (Experiment examples 18, 23, 28, 33, etc.), the transfer efficiency was higher than that in a case where the dyeing-target image G1 was not formed (Experiment examples 17, 22, 27, 32, etc.), independently of the color of the textile printing image G2.

Moreover, in a case where the dyeing-target images G11 and G13 were formed together with the textile printing image G12 (Experiment examples 19 to 21, 24 to 26, 29 to 31, 34 to 36, etc.), the transfer efficiency was higher than that in a case where the dyeing-target image G13 was not formed (Experiment examples 18, 23, 28, and 33), independently of the color of the textile printing image G12.

In particular, among the cases where the dyeing-target images G11 and G13 were formed, the transfer efficiency was higher as the disposed amount of the dyeing-target image G13 was greater. In these cases, the transfer efficiency was sufficiently high when the disposed amount of the dyeing-target image G13 was from 0.25 mg/cm$^2$ to 0.68 mg/cm$^2$.

According to the results described above, the efficiency of transferring the image G onto the non-print medium L such as fabric was improved when the image G formed on the print medium M was transferred onto the non-print medium L by disposing, on the print medium M, the dyeing-target toner image Z11 formed with the dyeing-target toner including the polymer compound to be dyed with the textile printing dye, the textile printing toner image Z12 formed with the textile printing toner including the textile printing dye, and the dyeing-target toner image Z13 formed with the foregoing dyeing-target toner. Accordingly, the image I with further higher quality was formed on the non-print medium L.

The technology has been described above referring to some example embodiments and the modification examples thereof; however, the technology is not limited to the example embodiments and the modification examples described above, and is modifiable in various ways.

For example, the image forming apparatus according to one example embodiment of the technology is not limited to a printer, and may be a copying machine, a facsimile, a multi-functional apparatus, or any other suitable apparatus that forms an image.

It is possible to achieve at least the following configurations from the above-described example embodiments of the technology.

(1)

An image forming apparatus including an image forming section that includes: a first toner image forming unit that forms a textile printing toner image with a textile printing toner; and a second toner image forming unit that forms a first dyeing-target toner image with a dyeing-target toner, the image forming section disposing the textile printing toner image and the first dyeing-target toner image in this order on a print medium, the textile printing toner including a textile printing dye, the dyeing-target toner including a polymer compound that is to be dyed with the textile printing dye.

(2)

The image forming apparatus according to (1), in which the second toner image forming unit further forms a second dyeing-target toner image with the dyeing-target toner, and the image forming section disposes the second dyeing-target toner image on the print medium, and thereafter disposes the textile printing toner image and the first dyeing-target toner image in this order on the second dyeing-target toner image disposed on the print medium.

(3)

The image forming apparatus according to (2), in which an amount of the second dyeing-target toner image disposed on the print medium is equal to or more than about 0.25 milligrams per square centimeter and equal to or less than about 0.68 milligrams per square centimeter.

(4)

The image forming apparatus according to any one of (1) to (3), in which the polymer compound includes polyester-based resin.

(5)

The image forming apparatus according to any one of (1) to (4), in which the dyeing-target toner includes no colorant.

(6)

The image forming apparatus according to any one of (1) to (5), in which the dyeing-target toner is a clear toner.

(7)

The image forming apparatus according to (1), in which the image forming section further includes a transfer section that includes an intermediate transfer medium, the transfer section transferring the first dyeing-target toner image and the textile printing toner image in this order onto the intermediate transfer medium, and thereafter transferring the textile printing toner image and the first dyeing-target toner image in this order from the intermediate transfer medium onto the print medium.

(8)

The image forming apparatus according to (1), further including a fixing section that fixes, to the print medium, the textile printing toner image and the first dyeing-target toner image disposed on the print medium.

According to the image forming apparatus of one embodiment of the technology, the image forming section disposes, on the print medium, the textile printing toner image formed with the textile printing toner including the textile printing dye and the dyeing-target toner image formed with the dyeing-target toner including the polymer compound to be dyed with the textile printing toner in this order. Accordingly, when the image formed on the print medium is transferred onto a non-print medium such as fabric, it is possible to form an image with higher quality on the non-print medium.

The controller 71 illustrated in FIG. 3 is implementable by circuitry that includes at least one application specific integrated circuit (ASIC), at least one semiconductor integrated circuit, and/or at least one field programmable gate array (FPGA). Non-limiting example of the at least one semiconductor integrated circuit may include at least one processor such as a central processing unit (CPU). At least one processor is configurable to perform all or a part of functions of the controller 71 illustrated in FIG. 3, by reading instructions from at least one machine readable tangible non-transitory medium. Such a medium may take many forms. Non-limiting examples of the form of such a medium may include any type of magnetic medium such as a hard disk, any type of optical medium such as a CD and a DVD, any type of semiconductor memory (i.e., semiconductor circuit) such as a volatile memory and a non-volatile memory. Non-limiting examples of the volatile memory may include a DRAM and a SRAM. Non-limiting examples of the nonvolatile memory may include a ROM and a NVRAM. The ASIC is an integrated circuit (IC) customized to perform all or a part of the functions of the controller 71 illustrated in FIG. 3. The FPGA is an integrated circuit designed to be configured after manufacturing in order to perform all or a part of the functions of the controller 71 illustrated in FIG. 3.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising an image forming section that includes:

a first toner image forming unit that forms a textile printing toner image with a textile printing toner; and a second toner image forming unit that forms a first dyeing-target toner image with a dyeing-target toner, the image forming section disposing the textile printing toner image and the first dyeing-target toner image in this order on a print medium, the textile printing toner including a textile printing dye having a sublimation transfer property, the dyeing-target toner including a polymer compound that is to be dyed with the textile printing dye.

2. The image forming apparatus according to claim 1, wherein the polymer compound includes polyester-based resin.

3. The image forming apparatus according to claim 1, wherein the dyeing-target toner includes no colorant.

4. The image forming apparatus according to claim 1, wherein the dyeing-target toner is a clear toner.

5. The image forming apparatus according to claim 1, wherein the image forming section further includes a transfer section that includes an intermediate transfer medium, the transfer section transferring the first dyeing-target toner image and the textile printing toner image in this order onto the intermediate transfer medium, and thereafter transferring the textile printing toner image and the first dyeing-target toner image in this order from the intermediate transfer medium onto the print medium.

6. The image forming apparatus according to claim 1, further comprising a fixing section that fixes, to the print medium, the textile printing toner image and the first dyeing-target toner image disposed on the print medium.

7. The image forming apparatus according to claim 1, wherein an endothermic amount of the textile printing toner measured by a differential scanning calorimeter is in a range from 0.41 mJ/mg to 1.51 mJ/mg.

8. An image forming apparatus, comprising an image forming section that includes:

a first toner image forming unit that forms a textile printing toner image with a textile printing toner; and a second toner image forming unit that forms a first dyeing-target toner image with a dyeing-target toner, the image forming section disposing the textile printing toner image and the first dyeing-target toner image in this order on a print medium, the textile printing toner including a textile printing dye having a sublimation transfer property, the dyeing-target toner including a polymer compound that is to be dyed with the textile printing dye, wherein the second toner image forming unit further forms a second dyeing-target toner image with the dyeing-target toner, and the image forming section disposes the second dyeing-target toner image on the print medium, and thereafter disposes the textile printing toner image and the first dyeing-target toner image in this order on the second dyeing-target toner image disposed on the print medium.

9. The image forming apparatus according to claim 8, wherein an amount of the second dyeing-target toner image disposed on the print medium is equal to or more than about 0.25 milligrams per square centimeter and equal to or less than about 0.68 milligrams per square centimeter.

* * * * *